US006646377B2

(12) United States Patent
Hashimoto

(10) Patent No.: US 6,646,377 B2
(45) Date of Patent: Nov. 11, 2003

(54) ELECTRODE STRUCTURE FOR PLASMA DISPLAY PANEL

(75) Inventor: Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 71 days.

(21) Appl. No.: 09/920,939

(22) Filed: Aug. 3, 2001

(65) Prior Publication Data

US 2002/0135303 A1 Sep. 26, 2002

(30) Foreign Application Priority Data

Mar. 21, 2001 (JP) ..... 2001-080968

(51) Int. Cl.[7] ..... H01J 17/49
(52) U.S. Cl. ..... 313/582; 313/631
(58) Field of Search ..... 313/582, 583, 313/584, 585, 586, 587, 39, 581, 574, 631, 632

(56) References Cited

U.S. PATENT DOCUMENTS 6,265,826 B1 * 7/2001 Miyazaki ..... 313/586
6,522,072 B1 * 2/2003 Yura et al. ..... 313/582

FOREIGN PATENT DOCUMENTS

JP HEI 9 231907 9/1997
JP 2000-195431 7/2000

* cited by examiner

*Primary Examiner*—Nimeshkumar D. Patel
*Assistant Examiner*—Jason Phinney
(74) *Attorney, Agent, or Firm*—Staas & Halsey LLP

(57) ABSTRACT

An electrode structure for a plasma display panel has a plurality of unit discharge sections arranged in a discharge space. The electrode structure includes a pair of bus electrodes, and a pair of branch electrodes respectively extending from the bus electrodes in each of the unit discharge sections. The bus electrodes each extend along a row of the matrix array of the unit discharge sections. The branch electrodes each obliquely extend across a discharge region in each of the unit discharge sections so that the discharge gap defined between the branch electrodes is skewed with respect to a column of the matrix array of the unit discharge sections.

19 Claims, 35 Drawing Sheets

ELECTRODE STRUCTURE FOR PLASMA DISPLAY PANEL

BACKGROUND OF THE INVENTION

1. Field of the Invention

The present invention relates to an electrode structure for a plasma display panel (PDP) and, more particularly, to an electrode structure to be provided in each cell of a PDP.

2. Description of the Related Art

A conventional PDP cell structure will first be described in connection with a surface discharge PDP having paired display electrodes (primary electrodes) provided on a substrate for light emission.

FIG. 35 is a perspective view illustrating a part of a common AC-driven three-electrode surface discharge PDP for color display.

As shown, the PDP includes a front panel assembly and a rear panel assembly. The front panel assembly includes a front glass substrate 11, pairs of display electrodes X, Y arranged parallel to each other on the front substrate 11 for surface discharge, and a dielectric layer 17 of a glass material provided over the display electrodes. A protective film such as of MgO (not shown) is provided on the dielectric layer 17. The display electrodes X, Y each include a transparent electrode 12 such as of ITO and a bus electrode 13 of a metal.

The rear panel assembly includes a rear glass substrate 21, address electrodes (signal electrodes) A arranged perpendicularly to the display electrodes X, Y on the rear substrate 21, barrier ribs 29 provided between the address electrodes A and A for partitioning a discharge space, and red, green and blue fluorescent layers 28R, 28G and 28B provided between the barrier ribs 29.

The rear panel assembly and the front panel assembly are combined in an opposed relation with the periphery thereof sealed, and the discharge space defined therebetween is filled with a discharge gas. Intersections between the paired display electrodes X, Y and the address electrodes A each define a discharge region of a unit light emitting cell. The pairs of display electrodes X and Y each define a display line therebetween. Each pixel includes three unit discharge sections (sub-pixels), i.e., RGB unit discharge sections, arranged in juxtaposition. Therefore, the RGB unit discharge sections are arranged in a grid pattern in the PDP.

The display electrodes X, Y are generally referred to as "primary electrodes" or "sustain electrodes", because they serve to induce a primary discharge and to sustain light emission in the PDP. For convenience of explanation, the transparent electrodes 12 of the display electrodes X, Y are herein referred to as "branch electrodes".

FIG. 36 is a diagram illustrating the unit discharge sections of the PDP of FIG. 35 arranged in a grid pattern as viewed in plan, and FIG. 37 is a diagram illustrating a positional relationship between the unit discharge sections and the display electrodes of the PDP of FIG. 35 as viewed in plan.

As shown in FIG. 36, the unit discharge sections K of the PDP each have a rectangular shape, and are arranged in a grid pattern. Discharge gaps are respectively provided in the unit discharge sections K as viewed in plan. In some cases, the unit discharge sections K are arranged in a special configuration (e.g., a delta configuration), but generally each correspond to an R, G or B minimum light emitting unit (sub-pixel). Each set of RGB unit discharge sections are arranged in a square or generally square configuration, so that the unit discharge sections K each have a vertically elongated rectangular shape.

As shown in FIG. 37, the discharge space is generally partitioned on a column-by-column basis by the barrier ribs 29 to provide discharge regions H within the respective unit discharge sections as viewed in plan. Therefore, the discharge regions in the unit discharge sections each have a further smaller width. That is, the discharge regions H are each defined as a region provided by excluding barrier rib regions from the unit discharge section K.

As viewed in plan, the discharge gaps D are each defined as a slit between the branch electrodes 12 of the display electrodes X and Y. A space defined between the bus electrodes 13 of the paired display electrodes X, Y is generally referred to as a reverse slit (or a non-discharge slit).

FIG. 38 is a diagram illustrating an electrode structure of the PDP of FIG. 35 as viewed in plan. In FIG. 38, the barrier ribs 29 are located in non-discharge regions. As described above, the discharge regions H are provided by excluding the barrier rib regions (non-discharge regions) from the unit discharge sections K.

In such an electrode structure, the discharge gaps D each have a relatively small gap length L, so that the discharge is concentrated in the discharge gaps. Therefore, the protective film in the discharge gaps are liable to be deteriorated. For this reason, the gap length of the discharge gaps is increased by skewing the discharge gaps with respect to a row of the unit discharge sections, as disclosed in Japanese Unexamined Patent Publication No. 9-231907 (1998).

FIGS. 39 and 40 are diagrams illustrating exemplary electrode structures in which the discharge gaps are skewed with respect to the unit discharge sections.

As shown, the gap length L of the discharge gaps D in the electrode structures is increased for prevention of the partial deterioration of the protective film. Another electrode structure with skewed discharge gaps is disclosed in Japanese Unexamined Patent Publication No. 2000-195431.

It is known that the luminous intensity on an electrode increases toward a discharge gap (see, for example, T. Yoshioka, et al., "Characterization of Micro-Cell Discharge in AC-PDPs by Spatio-temporal Optical Emission and Laser Absorption Spectroscopy", Proc. of IDW '99, 603(1999)). If the electrode is provided apart from the discharge gap in the discharge region, the luminous intensity on the electrode is reduced, resulting in a lower luminous efficiency.

In the electrode structure shown in FIG. 39, the width of each branch electrode 12 extending from a bus electrode 13 is varied along the length of the branch electrode for provision of a skewed discharge gap D, so that a greater width portion of the branch electrode has an area remote from the discharge gap D.

In the electrode structure shown in FIG. 40, each branch electrode 12 has branch portions in a discharge region for provision of a skewed discharge gap D, so that one of the branch portions of the branch electrode 12 extends apart from the discharge gap D. Therefore, the branch electrode has an area remote from the discharge gap D.

In view of the foregoing, the present invention is directed to an electrode structure for a plasma display panel, in which a pair of branch electrodes having a generally constant width but no branch portion in a discharge region respectively extend from bus electrodes to define a skewed discharge gap therebetween, so that the branch electrodes do not have an area remote from the discharge gap, thereby preventing the reduction of the luminous intensity for improvement of the luminous efficiency.

SUMMARY OF THE INVENTION

In accordance with the present invention, there is provided an electrode structure for a plasma display panel having a plurality of unit discharge sections arranged in a matrix array in a discharge space defined between a pair of substrates, the electrode structure comprising a pair of bus electrodes, and a pair of branch electrodes respectively extending from the bus electrodes in each of the unit discharge sections to define a discharge gap therebetween, wherein the bus electrodes each extend along a row of the matrix array of the unit discharge sections, wherein the branch electrodes each have a generally constant width and obliquely extend across a discharge region in each of the unit discharge sections so that the discharge gap defined between the branch electrodes is skewed with respect to a column of the matrix array of the unit discharge sections.

With this arrangement, the branch electrodes each have a generally constant width and obliquely extend across the discharge region in the unit discharge section, so that the discharge gap defined between the branch electrodes respectively extending from the bus electrodes are skewed with respect to the column of the matrix array of the unit discharge sections. Therefore, the branch electrodes do not have an area remote from the electrode gap, thereby preventing the reduction of the luminous efficiency for improvement of the luminous efficiency.

DETAILED DESCRIPTION OF THE PREFERRED EMBODIMENT(S)

Figure 1:
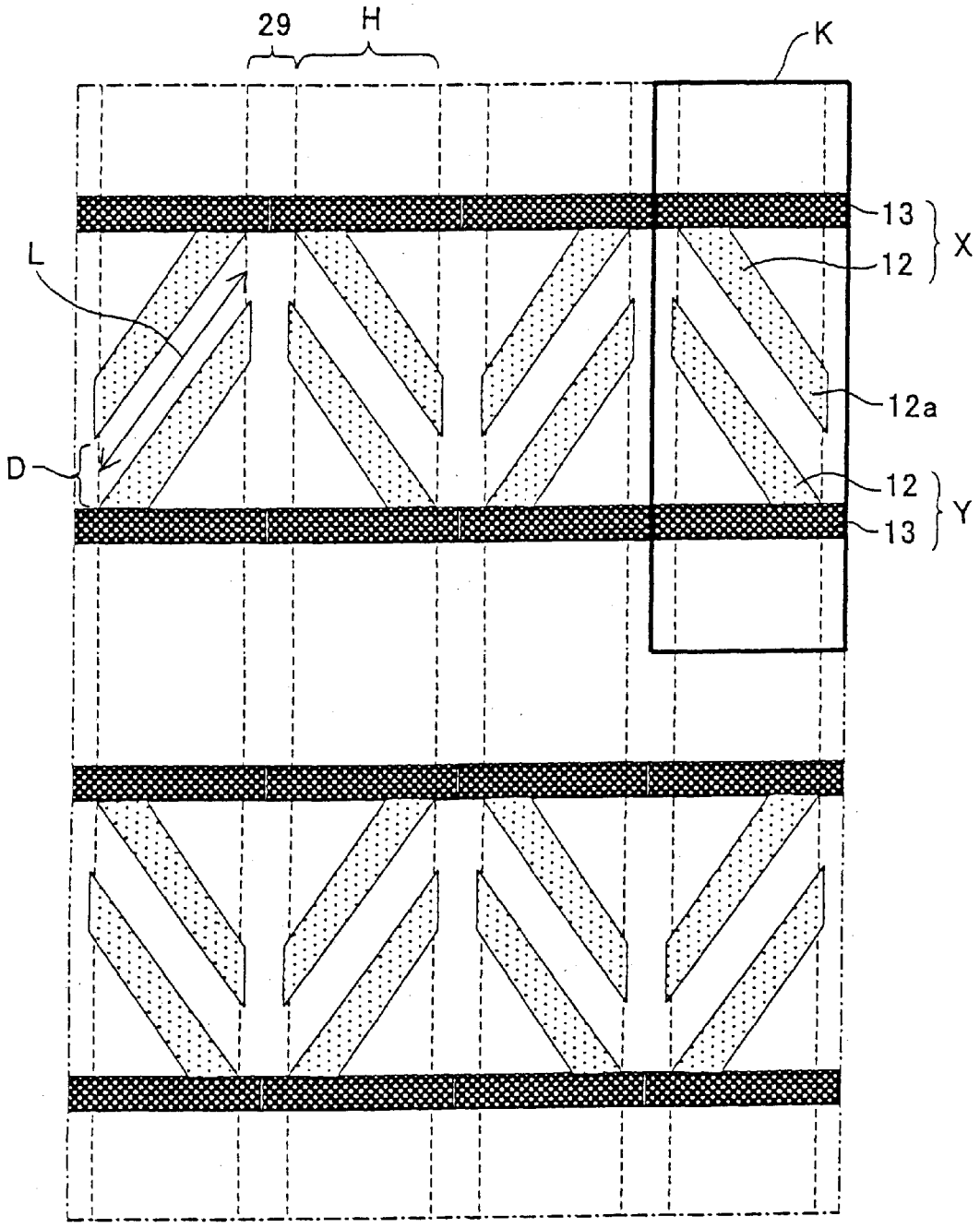
FIG. 1 is a diagram illustrating an electrode structure according to Embodiment 1 of the present invention.

With reference to the attached drawings, the present invention will hereinafter be described by way of embodiments thereof. It should be understood that the invention be not limited to these embodiments but various modifications may be made within the scope of the invention.

In accordance with the present invention, an electrode structure for a plasma display panel (PDP) having a plurality of unit discharge sections arranged in a matrix array in a discharge space defined between a pair of substrates includes a pair of bus electrodes, and a pair of branch electrodes respectively extending from the bus electrodes in each of the unit discharge sections to define a discharge gap therebetween. The bus electrodes each extend along a row of the matrix array of the unit discharge sections. The branch electrodes each have a generally constant width and obliquely extend across a discharge region in each of the unit discharge sections so that the discharge gap defined between the branch electrodes is skewed with respect to a column of the matrix array of the unit discharge sections.

The PDP electrode structure according to the invention is applicable to any of matrix PDPs such as of a DC-driven type, an AC-driven type, a surface discharge type, an opposed discharge type, a two-electrode structure and a three-electrode structure.

Usable as the pair of substrates are substrates composed of glass, quartz and ceramics. These substrates may be formed with desired structures such as electrodes, an insulating film, a dielectric film and a protective film.

The unit discharge sections each include the paired bus electrodes and the paired branch electrodes respectively extending from the bus electrodes, and are arranged in the matrix array. Where the PDP is adapted for color display, the unit display sections are minimum light emitting units (sub-pixels) of red (R), green (G) and blue(B) as viewed in plan. Since a set of RGB unit display sections are arranged in a square or generally square configuration, the unit display sections each have a vertically elongated rectangular shape. The discharge region is herein defined as a region provided by excluding a barrier rib region (non-discharge region) from the unit discharge section.

The bus electrodes each extend along the row of the matrix array of the unit discharge sections. The branch electrodes each have a generally constant width, and have no branch in the discharge region in the unit discharge section. The discharge gap defined between the paired branch electrodes respectively extending from the paired bus electrodes is skewed with respect to the column of the matrix array of the unit discharge sections.

Electrode materials and electrode formation methods known in the art are employed for formation of the bus electrodes and the branch electrodes. The bus electrodes are typically formed of a metal electrode material. Examples of the metal electrode material include Cu, Cr, Au and Ag. More specifically, the bus electrodes may be Cr/Cu/Cr three-layer electrodes. The branch electrodes are typically formed of a transparent electrode material. Examples of the transparent electrode material include ITO, $SnO_2$ and ZnO. Where the electrodes are formed of Ag or Au, the formation thereof is achieved by a printing method. Where the electrodes are formed of any of the other electrode materials, the formation thereof is achieved by employing a film formation method such as an evaporation method or a sputtering method in combination with an etching method. With any of these methods, a desired number of electrodes having a desired thickness and width can be formed at desired intervals.

Electrode structures according to specific embodiments of the present invention will hereinafter be descried in connection to an AC-driven three-electrode surface discharge PDP for color display.

In the present invention, display electrodes of the PDP are basically constituted by the bus electrodes of the metal electrode material and the branch electrodes of the transparent electrode material as described above. The electrode structures each have substantially the same construction as the electrode structure shown in FIGS. 35 to 40 except for the shape of the branch electrodes.

Embodiment 1

FIG. 1 is a diagram illustrating an electrode structure according to Embodiment 1 of the present invention. Display electrodes X, Y each have a bus electrode 13 and a branch electrode 12 extending from the bus electrode 13 in each unit discharge section K. The branch electrode 12 has a constant width, and linearly extends obliquely with respect to a row of unit discharge sections K. More specifically, the branch electrode 12 having the constant width extends across a discharge region H in the unit discharge section K. That is, the branch electrode 12 has neither a branch nor an end in the discharge region H. A non-discharge region 29 does not overlap the discharge region as viewed in plan, and barrier ribs are provided in the non-discharge region. As described above, the discharge region H is a region provided by excluding the non-discharge region 29 from the unit discharge section K. The bus electrode 13 is formed of a metal film having a Cr/Cu/Cr three-layer structure. The branch electrode 12 is formed of an ITO film. These electrodes are formed on a front glass substrate by a method known in the art.

A discharge gap D is defined between major portions of a pair of branch electrodes 12 extending in an opposed relation from a pair of opposed bus electrodes 13, and skewed with respect to a row of a pixel matrix array.

The branch electrodes 12 face the discharge gap D along the entire length thereof, and each have a constant width except for a distal end portion 12*a* thereof. Therefore, the branch electrodes 12 do not have an area remote from the discharge gap D.

The distal end portion 12*a* of the branch electrode 12 reaches the non-discharge region 29, so that the discharge gap D extends across the discharge region H. Therefore, the discharge region H can efficiently be utilized. Even if a spacing between each adjacent pair of barrier ribs 29 is small, the discharge gap D has a sufficiently great gap length L, so that the PDP is allowed to have a more fine structure. In addition, a protective film provided over the dielectric layer on the electrodes is prevented from being partially deteriorated.

Figure 2:
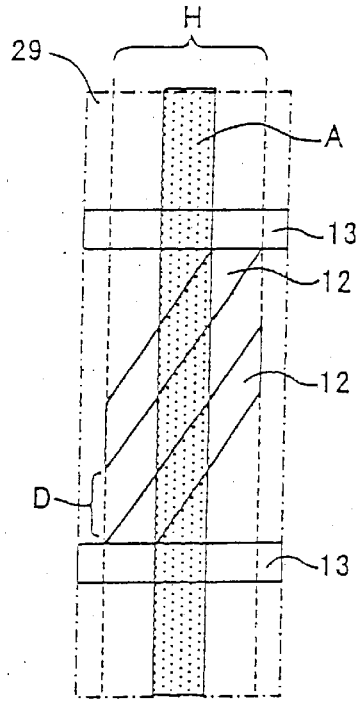
FIG. 2 is a diagram for explaining an address electrode structure according to Embodiment 1.

FIG. 2 is a diagram for explaining an address electrode structure. Only one unit discharge section K is shown in FIG. 2. As shown, address electrodes A each extend perpendicularly to the bus electrodes 13 as in the PDP shown in FIG. 35. The address electrodes A are each formed of the same material as the bus electrodes 13 by a method known in the art.

Figure 3:
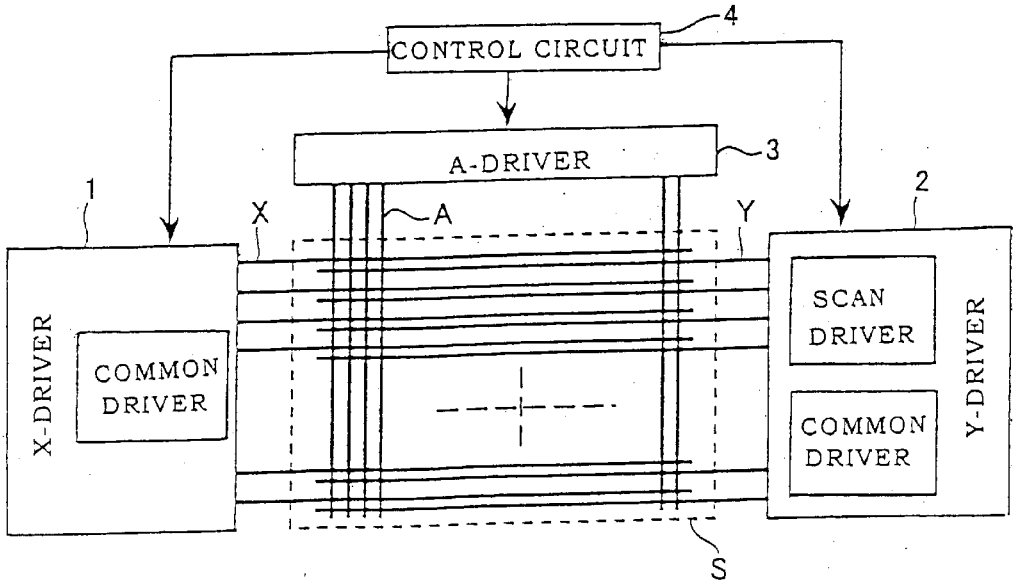
FIG. 3 is a diagram illustrating an exemplary driving circuit for a PDP according to Embodiment 1.

FIG. 3 is a diagram illustrating an exemplary driving circuit for the PDP. As shown, the display electrodes X, Y and the address electrodes A are provided in a screen S. The driving circuit includes an X-driver 1 connected to the display electrodes X, a Y-driver 2 connected to the display electrodes Y, an A-driver (address driver) 3 connected to the address electrodes A, and a control circuit 4 for controlling the X-driver 1, the Y-driver 2 and the A-driver 3. The Y-driver 2 includes a scan driver for application of a scan voltage, and a common driver for application of a sustain voltage. The X-driver 1 includes only a common driver for application of a sustain voltage.

Figure 4:
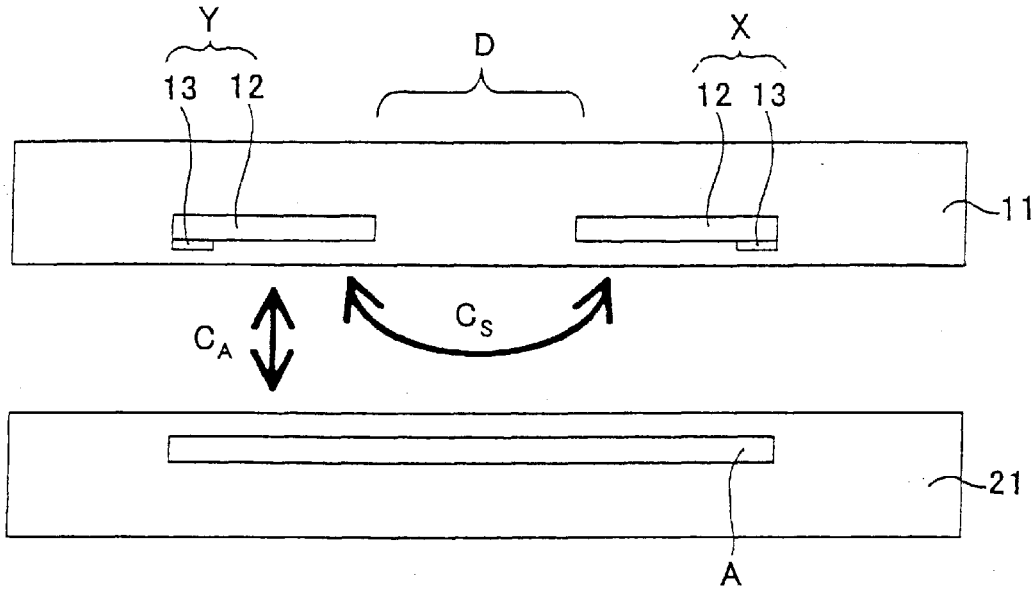
FIG. 4 is a diagram for explaining a discharge to be induced between display electrodes and an address electrode according to Embodiment 1.

FIG. 4 is a diagram for explaining discharges to be induced between the display electrodes and the address electrodes. The PDP is driven in the following manner. While the scan voltage is sequentially applied to the display electrodes Y as scan electrodes, a voltage is applied to a desired address electrode A, whereby an address discharge $C_A$ is induced between the address electrode A and the branch electrode 12 of the display electrode Y. Thus, a cell to be actuated is selected. In turn, the sustain voltage is applied between the display electrodes X and Y to induce a sustain discharge $C_s$ between the branch electrode 12 of the display electrode X and the branch electrode 12 of the display electrode Y by utilizing wall charges generated on the dielectric layer on the display electrode Y. The sustain discharge is sustainably induced a number of times according to a luminance requirement for display.

Figure 5:
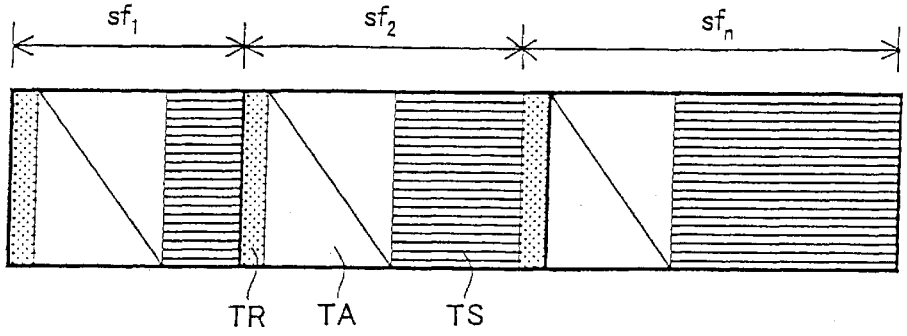
FIG. 5 is a diagram for explaining an exemplary driving sequence according to Embodiment 1.

FIG. 5 is a diagram for explaining an exemplary driving sequence. In the PDP, a gradation driving method called "address-display separated sub-field method" is employed for the display, in which a display period and an address period are separated from each other. In this gradation driving method, each frame (or each field if each frame consists of a plurality of fields) includes a plurality of sub-fields $sf_1$, $sf_2$, . . . , $sf_n$ weighted on a luminance basis, and each cell is actuated for a sub-field period according to the luminance requirement for the display.

The sub-fields $sf_n$ each include a reset period TR for initializing a wall charge state in each cell, an address period TA for selecting a cell to be actuated, and a sustain period TS for actuating the selected cell a number of times according to the luminance requirement.

Figure 6:
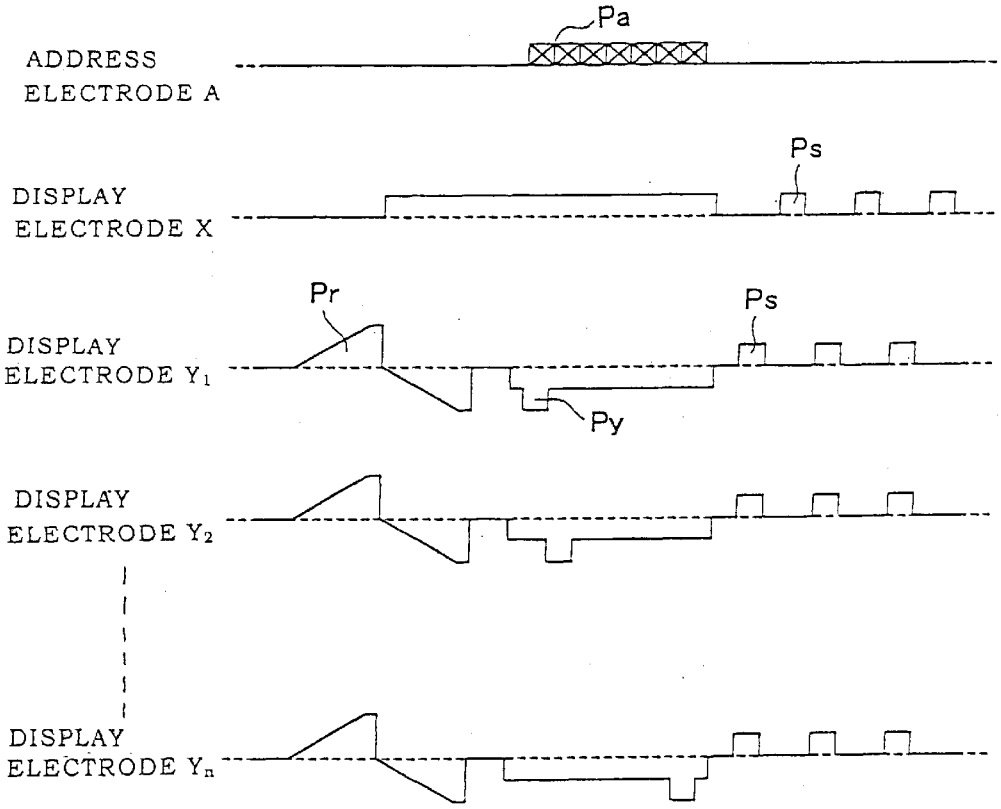
FIG. 6 is a diagram illustrating exemplary driving voltage waveforms according to Embodiment 1.

FIG. 6 is a diagram illustrating exemplary driving voltage waveforms.

During the reset period TR, erase pulses Pr are applied to respective cells to induce reset discharges therein for removal of charges from the cells. During the address period TA, scan pulses Py are sequentially applied to the cells, and an address pulse Pa is applied to a desired address electrode A to induce an address discharge only in the cell to be actuated for generation of charges in the cell. During the sustain period TS, sustain pulses Ps are alternately applied to the display electrodes X and Y to induce a sustain discharge for sustained actuation of the cell.

For the discharge during the address period TA, discharges are induced between the electrodes X, Y and A with the electrode Y serving as a common cathode. Therefore, the initialization discharge is achieved by inducing a discharge not only between the electrodes X and Y but also between the opposed electrodes (between the electrodes A and Y and between the electrodes A and X) for the initialization of the wall charge state.

There are two types of addressing methods for selecting a cell to be actuated: a writing addressing method in which charges in all the cells are first removed and then a charge is generated in a cell to be actuated; and an erasing addressing method in which charges are first generated in all the cells and then charges are removed from cells not to be actuated. Either of the addressing methods may be employed, though the driving waveform diagram shown in FIG. 6 is based on the writing addressing method.

First Modification of Embodiment 1

Figure 7:
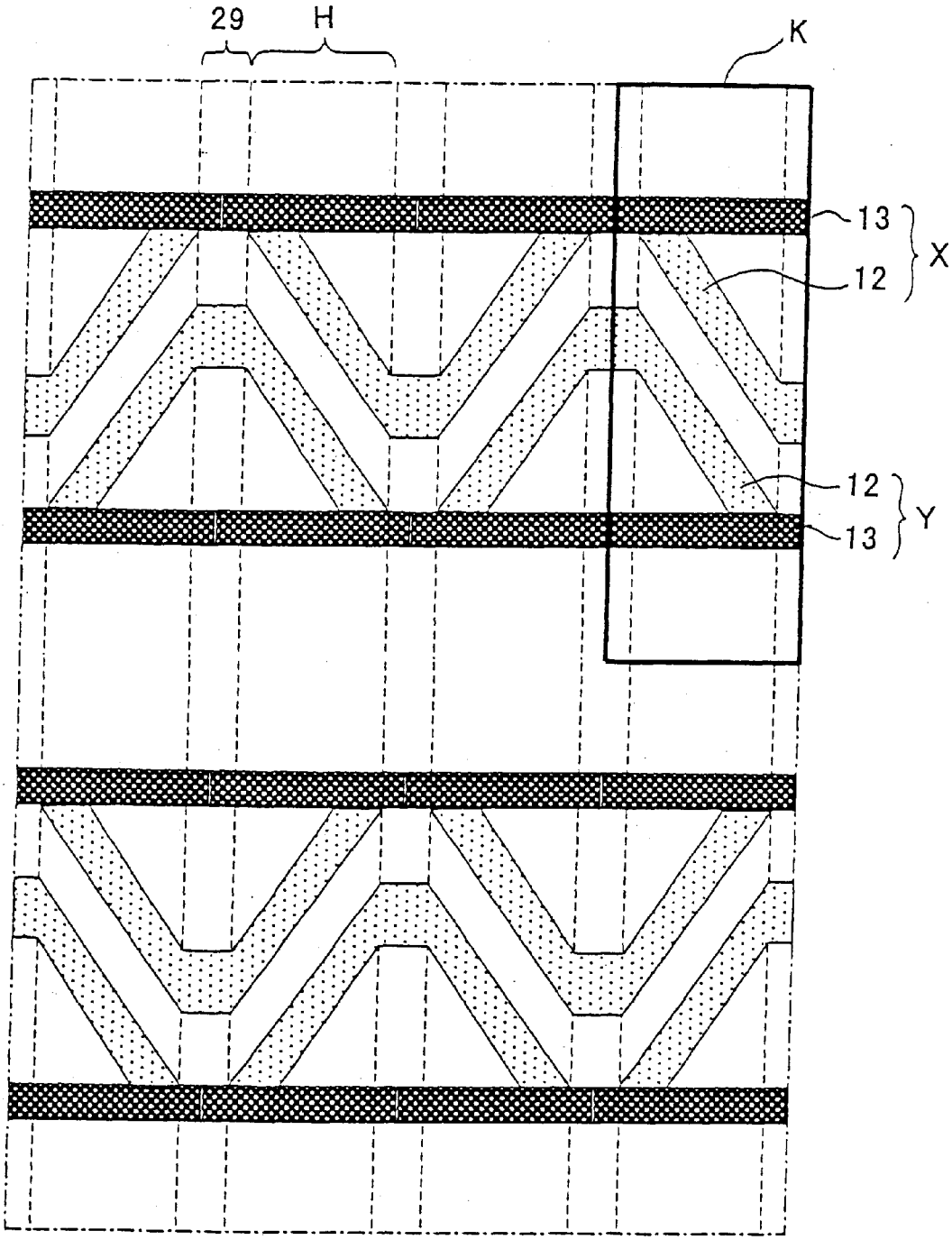
FIG. 7 is a diagram illustrating a first modification of Embodiment 1.

FIG. 7 is a diagram illustrating a first modification of Embodiment 1. In the first modification of Embodiment 1, the display electrodes X, Y are each constructed such that branch electrodes 12 extending from the bus electrode 13 in each adjacent pair of unit discharge sections K arranged in a row are connected to each other. With this arrangement, the branch electrodes 12 are connected to the bus electrode 13 at two points. Even if one of the branch electrodes 12 is broken, there is a bypass for current supply to the branch electrodes, thereby improving the reliability.

Second Modification of Embodiment 1

Figure 8:
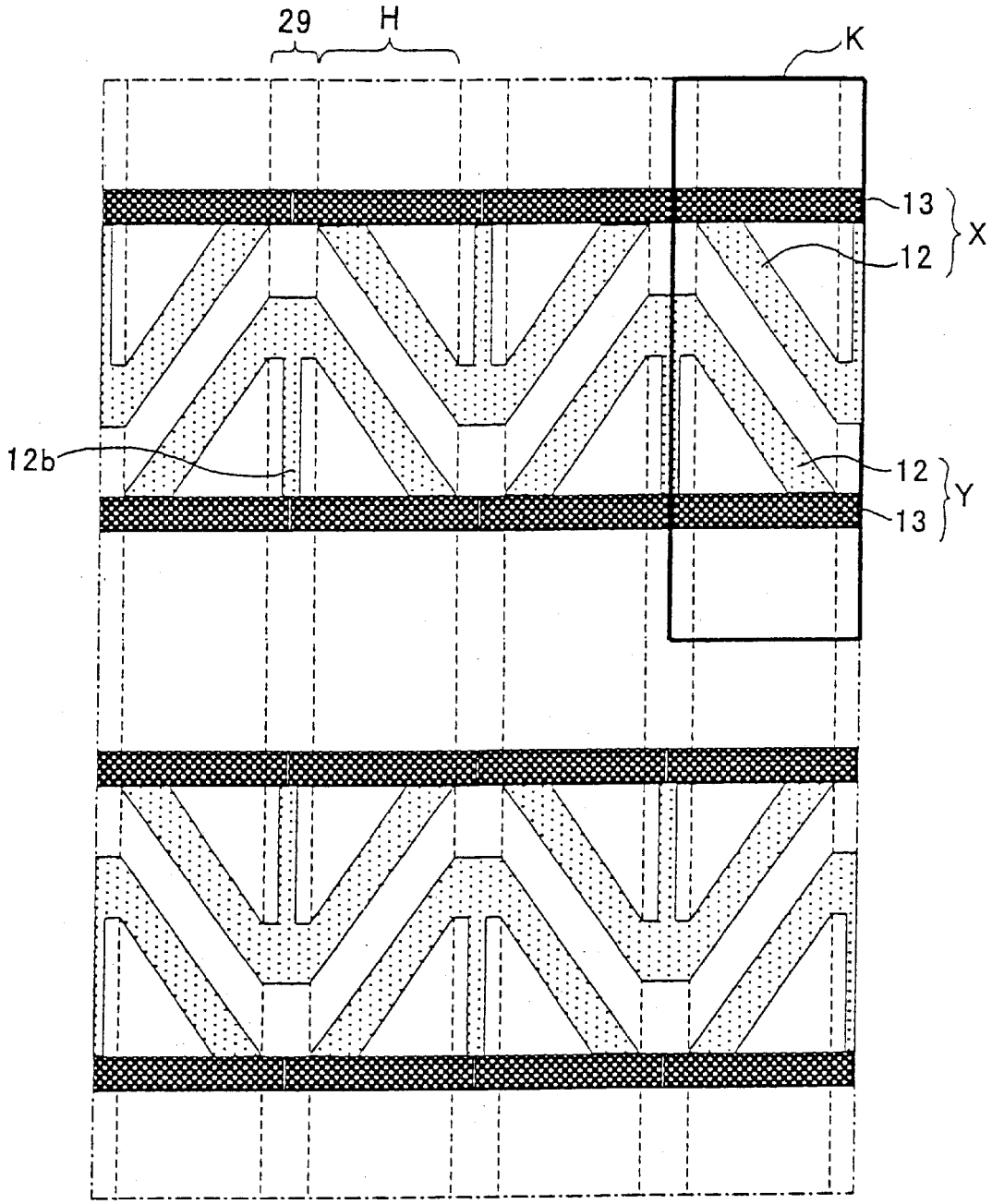
FIG. 8 is a diagram illustrating a second modification of Embodiment 1.

FIG. 8 is a diagram illustrating a second modification of Embodiment 1. In the second modification of Embodiment 1, the display electrodes X, Y are each configured such that the branch electrode 12 has a branch portion 12*b* extending along the non-discharge region 29 so as to be connected to the bus electrode 13. Even with the branch portion 12*b* provided in the non-discharge region 29, the branch electrode 12 does not have an area remote from the discharge gap D within the discharge region H. With this arrangement, the number of connection points between the branch electrode 12 and the bus electrode 13 is increased, thereby enhancing the reliability. Where the branch portion 12*b* is formed of a metal film in the non-discharge region 29, the electrical resistance of the branch portion can advantageously be reduced.

Embodiment 2

Figure 9:
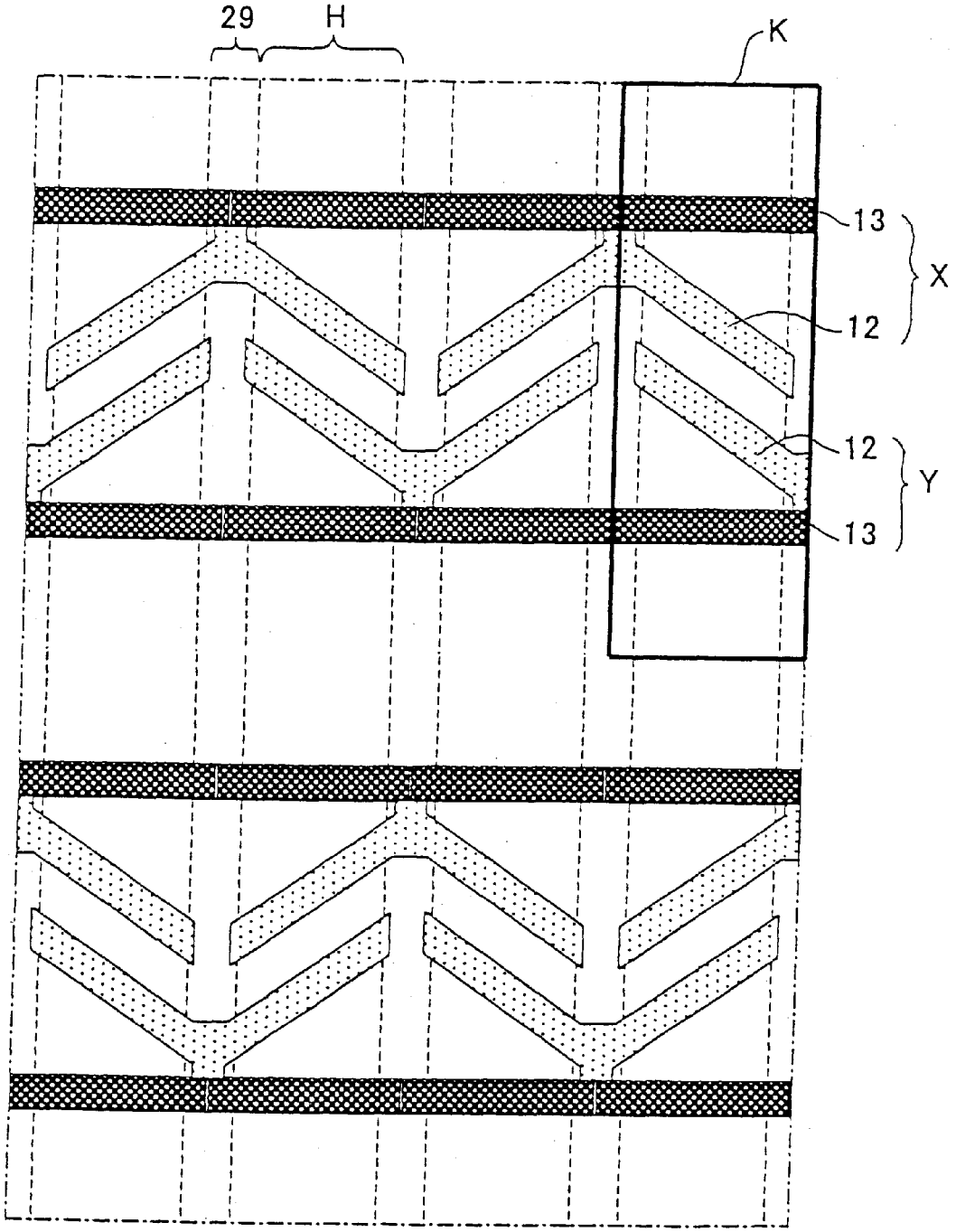
FIG. 9 is a diagram illustrating an electrode structure according to Embodiment 2 of the present invention.

FIG. 9 is a diagram illustrating an electrode structure according to Embodiment 2. In this embodiment, display electrodes X, Y each have substantially the same construction as in Embodiment 1, except that the branch electrode 12 has a portion extending from the bus electrode 13 in the non-discharge region 29. Since the bus electrode 13 is typically formed of a metal film, emitted light is blocked by the bus electrode, and a discharge is needlessly induced on the bus electrode 13. In this electrode structure, however, the bus electrode 13 is remote from the discharge gap D, so that the discharge induced in the vicinity of the discharge gap D can efficiently be utilized. For reduction of the intensity of the needless discharge on the bus electrode 13, the thickness of the dielectric layer on the bus electrode 13 may be increased, or an area occupied by the bus electrode 13 within the discharge region H may be reduced by providing a barrier rib along the bus electrode 13, though such an arrangement is not limited to this particular embodiment.

Embodiment 3

Figure 10:
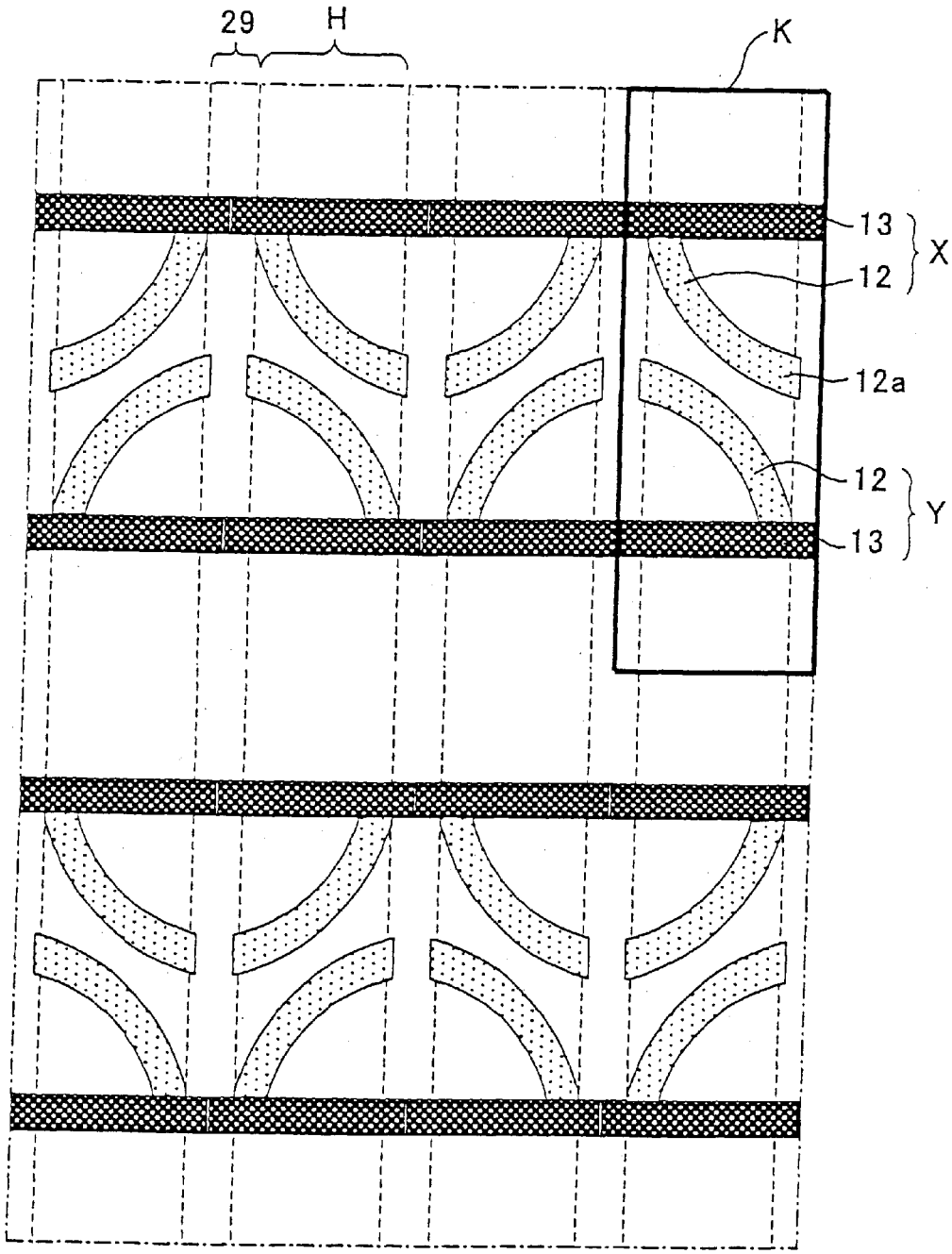
FIG. 10 is a diagram illustrating an electrode structure according to Embodiment 3 of the present invention.

FIG. 10 is a diagram illustrating an electrode structure according to Embodiment 3. In this embodiment, display electrodes X, Y each have substantially the same construction as in Embodiment 1, except that the branch electrode 12 is not linear but curved (arcuate). In the electrode structure shown in FIG. 1, the distal end portion 12*a* of the branch electrode 12 overlaps the barrier rib 29, or extends to the vicinity of the barrier rib 29. Therefore, the barrier rib 29 intervenes between the distal end portion 12*a* of the branch electrode 12 and the pair of opposed bus electrodes 13. If a distance between the distal end portion 12*a* of the branch electrode 12 and either of the opposed bus electrodes 13 is small, an inter-line capacitance therebetween is increased, so that a power loss is increased. In the electrode structure according to this embodiment, however, the distal end portion 12*a* of the branch electrode 12 can sufficiently be spaced from the opposed bus electrodes 13, thereby reducing the power loss.

Modification of Embodiment 3

Figure 11:
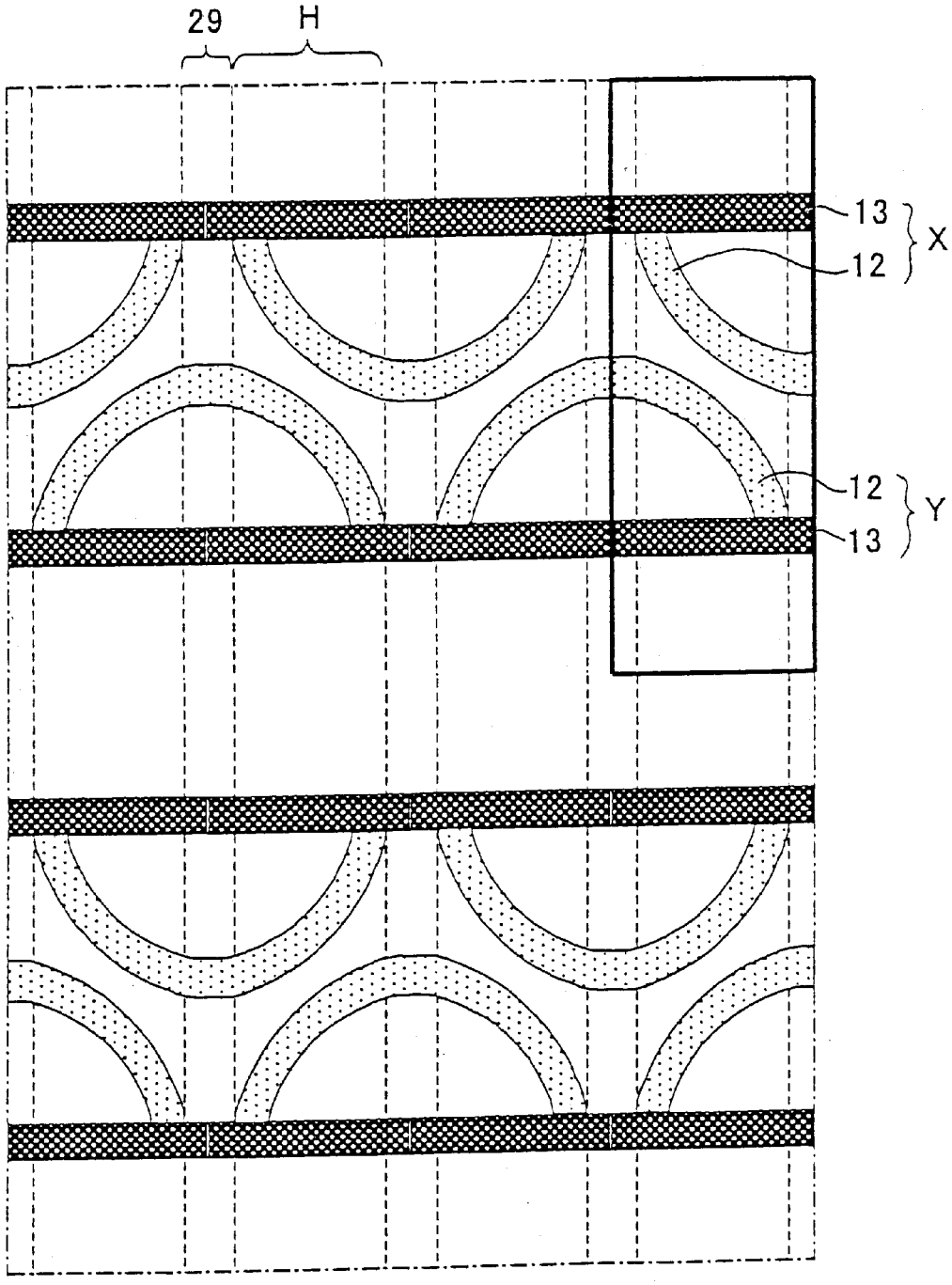
FIG. 11 is a diagram illustrating a modification of Embodiment 3.

FIG. 11 is a diagram illustrating a modification of Embodiment 3. In the modification of Embodiment 3, the display electrodes X, Y are each constructed such that curved branch electrodes 12 extending from the bus electrode 13 in each adjacent pair of unit discharge sections K arranged in a row are connected to each other. With this arrangement, the branch electrodes 12 are connected to the bus electrode 13 at two points. Even if one of the branch electrodes 12 is broken, there is a bypass for current supply to the branch electrodes, thereby improving the reliability. As in the second modification of Embodiment 1, the branch electrode 12 may have a branch portion extending along the non-discharge region 29 to be connected to the bus electrode 13.

Embodiment 4

Figure 12:
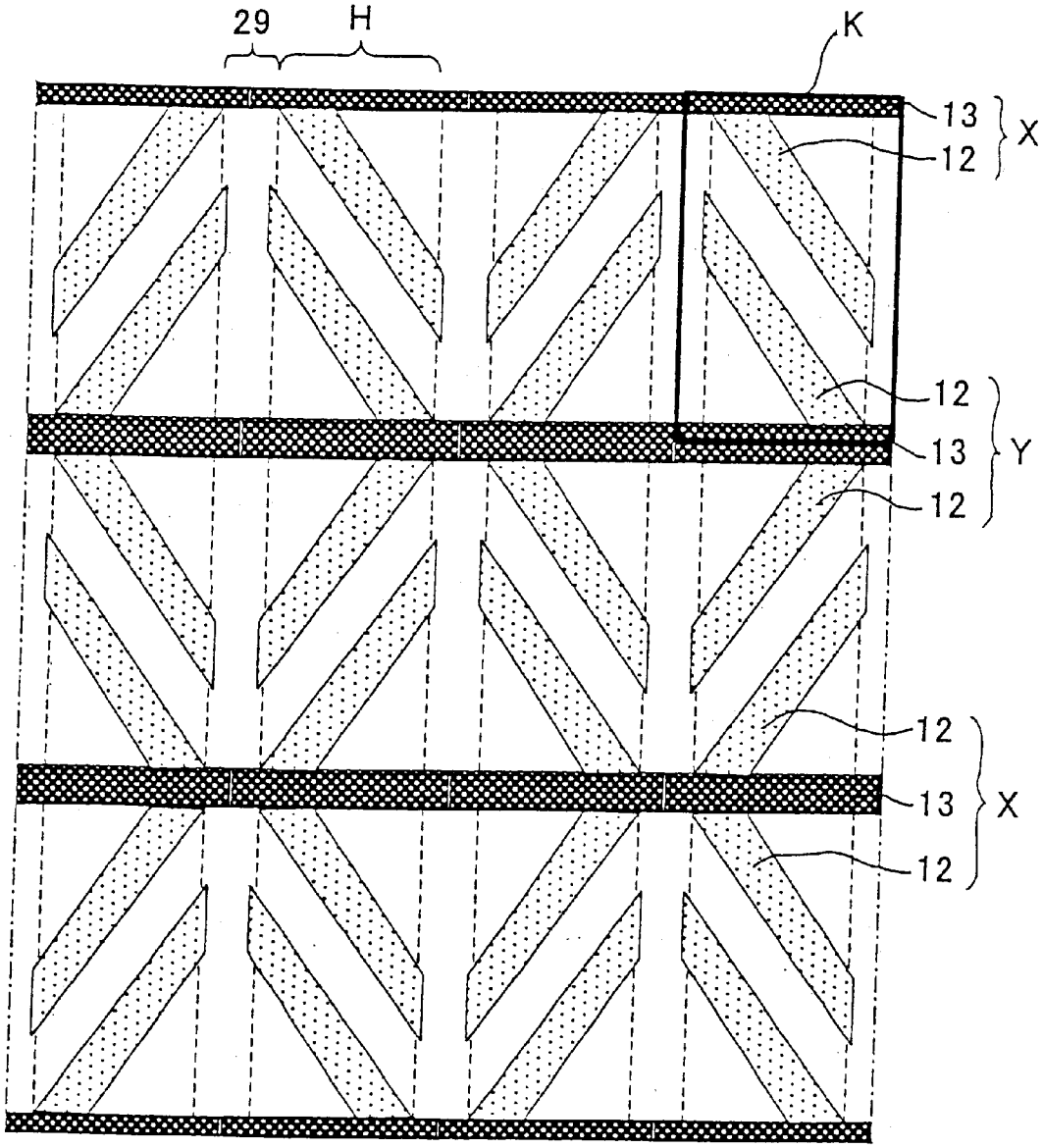
FIG. 12 is a diagram illustrating an electrode structure according to Embodiment 4 of the present invention.
Figure 13:
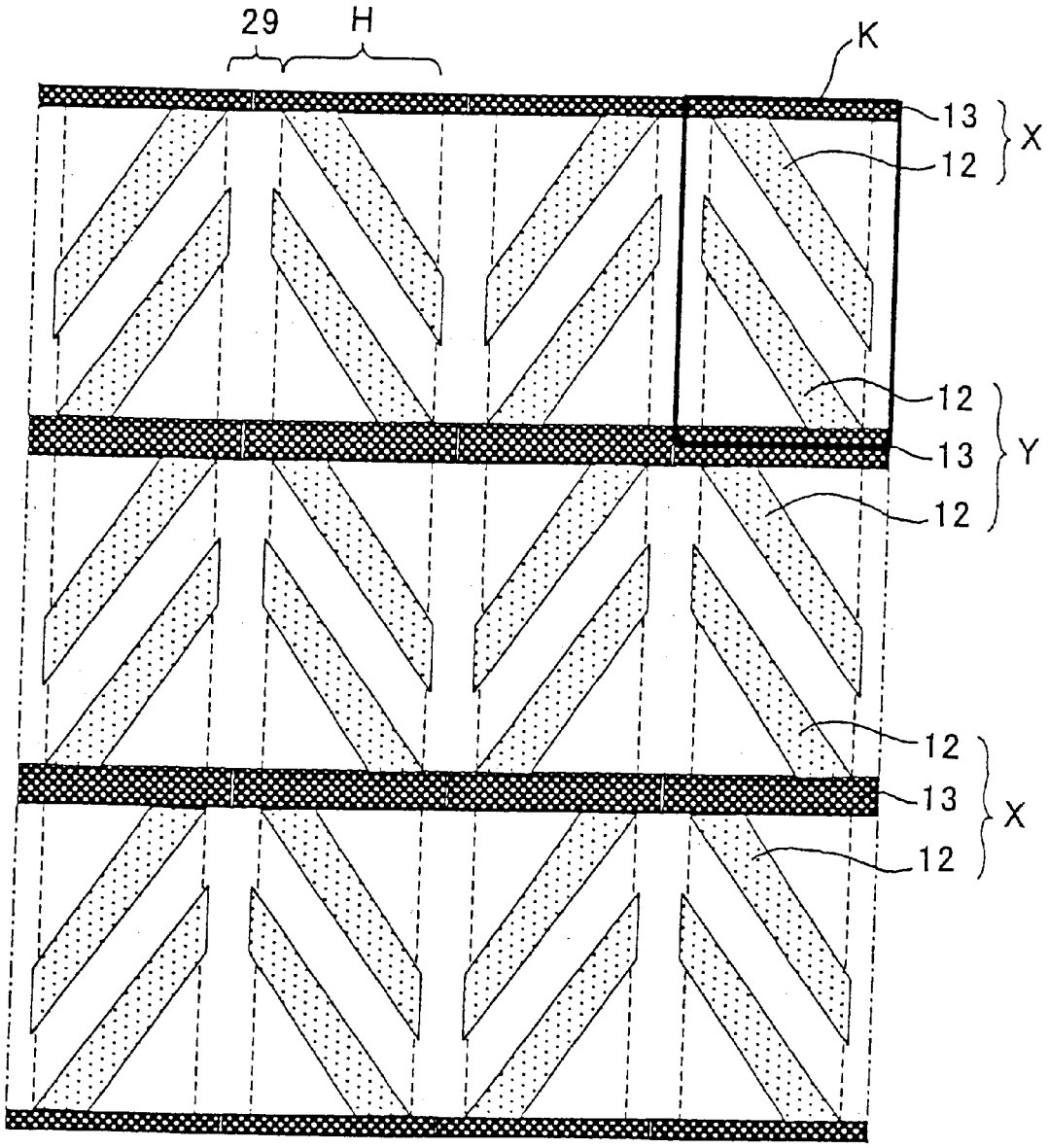
FIG. 13 is a diagram illustrating the electrode structure according to Embodiment 4.

FIGS. 12 and 13 are diagrams illustrating an electrode structure according to Embodiment 4. In this embodiment, display electrodes X, Y have substantially the same construction as in Embodiment 1, except that the bus electrode 13 is shared by an adjacent pair of cells arranged in a column. The present invention is applicable to such an electrode structure. In this case, there are two possible arrangements of branch electrodes 12 as shown in FIGS. 12 and 13, which are different in the extending directions of the branch electrodes 12 in each adjacent pair of cells arranged in a column. In the electrode structure shown in FIG. 12, the arrangement of the branch electrodes 12 is symmetric with respect to each bus electrode 13. In the electrode structure shown in FIG. 13, the arrangement of the branch electrodes 12 is the same for each bus electrode 13.

Modification of Embodiment 4

Figure 14:
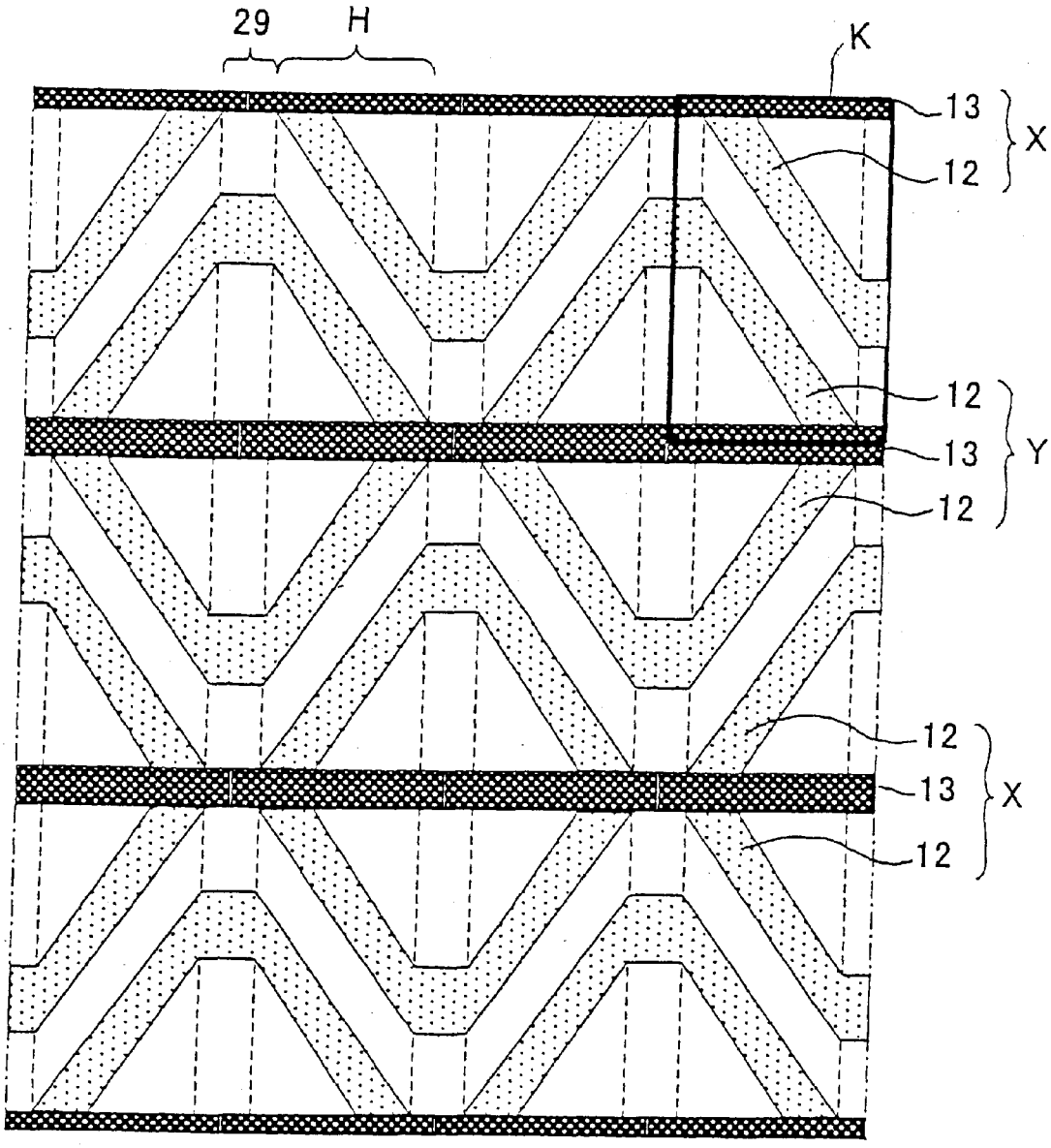
FIG. 14 is a diagram illustrating a modification of Embodiment 4.
Figure 15:
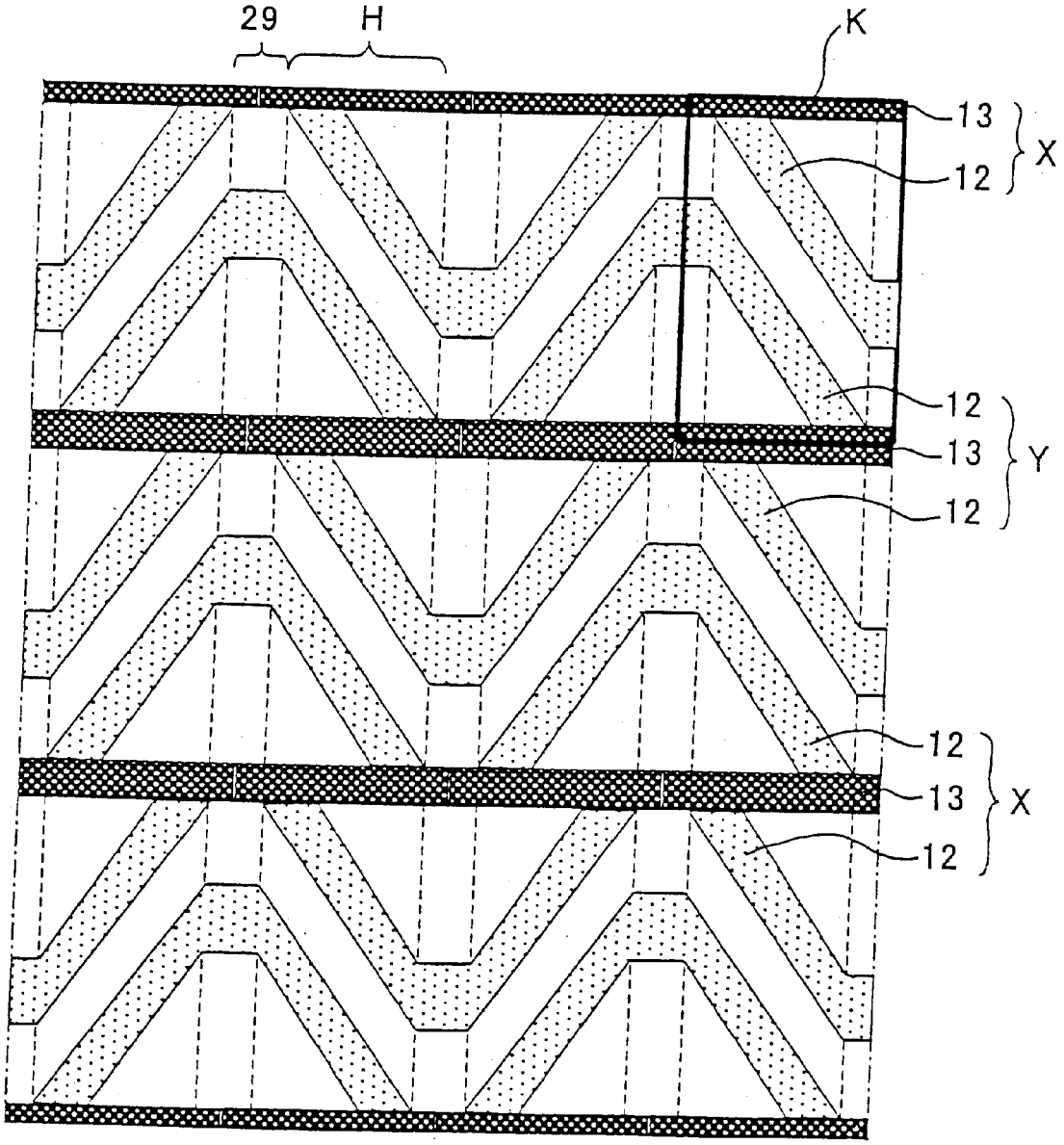
FIG. 15 is a diagram illustrating another modification of Embodiment 4.

FIGS. 14 and 15 are diagrams illustrating a modification of Embodiment 4. In the modification of Embodiment 4, the display electrodes X, Y are each constructed such that the branch electrodes 12 obliquely extending from the bus electrode 13 in each adjacent pair of unit discharge sections K arranged in a row are connected each other. In this case, there are two possible arrangements of the branch electrodes 12 as shown in FIGS. 14 and 15, which are different in the extending directions of the branch electrodes 12 in each adjacent pair of cells arranged in a column. The arrangements of the branch electrodes 12 shown in FIGS. 14 and 15 are substantially the same as the arrangements shown in FIGS. 12 and 13, respectively. As in the second modification of Embodiment 1, the branch electrode 12 may have a branch portion extending along the non-discharge region 29 to be connected to the bus electrode 13.

Embodiment 5

Figure 16:
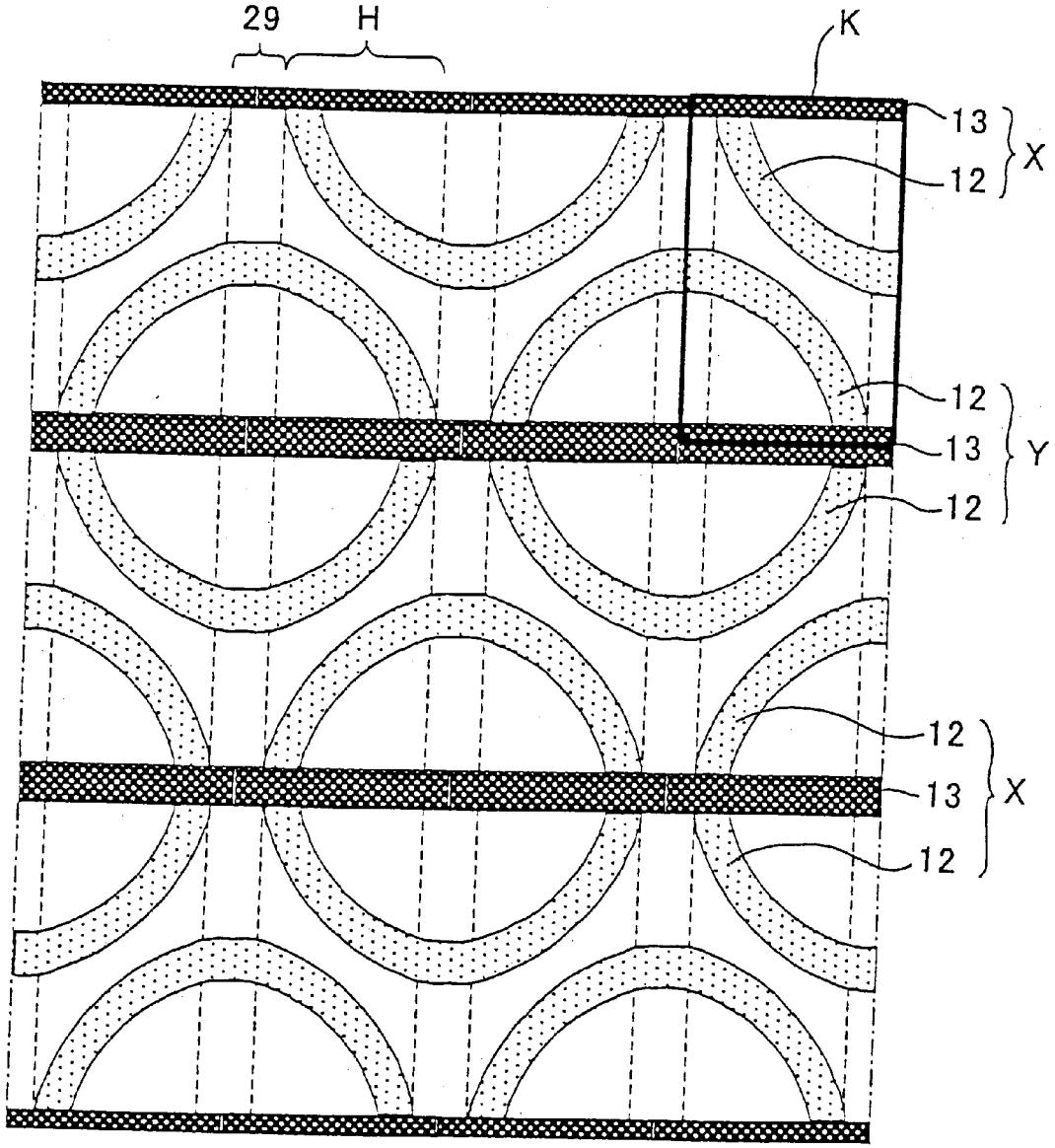
FIG. 16 is a diagram illustrating an electrode structure according to Embodiment 5 of the present invention.
Figure 17:
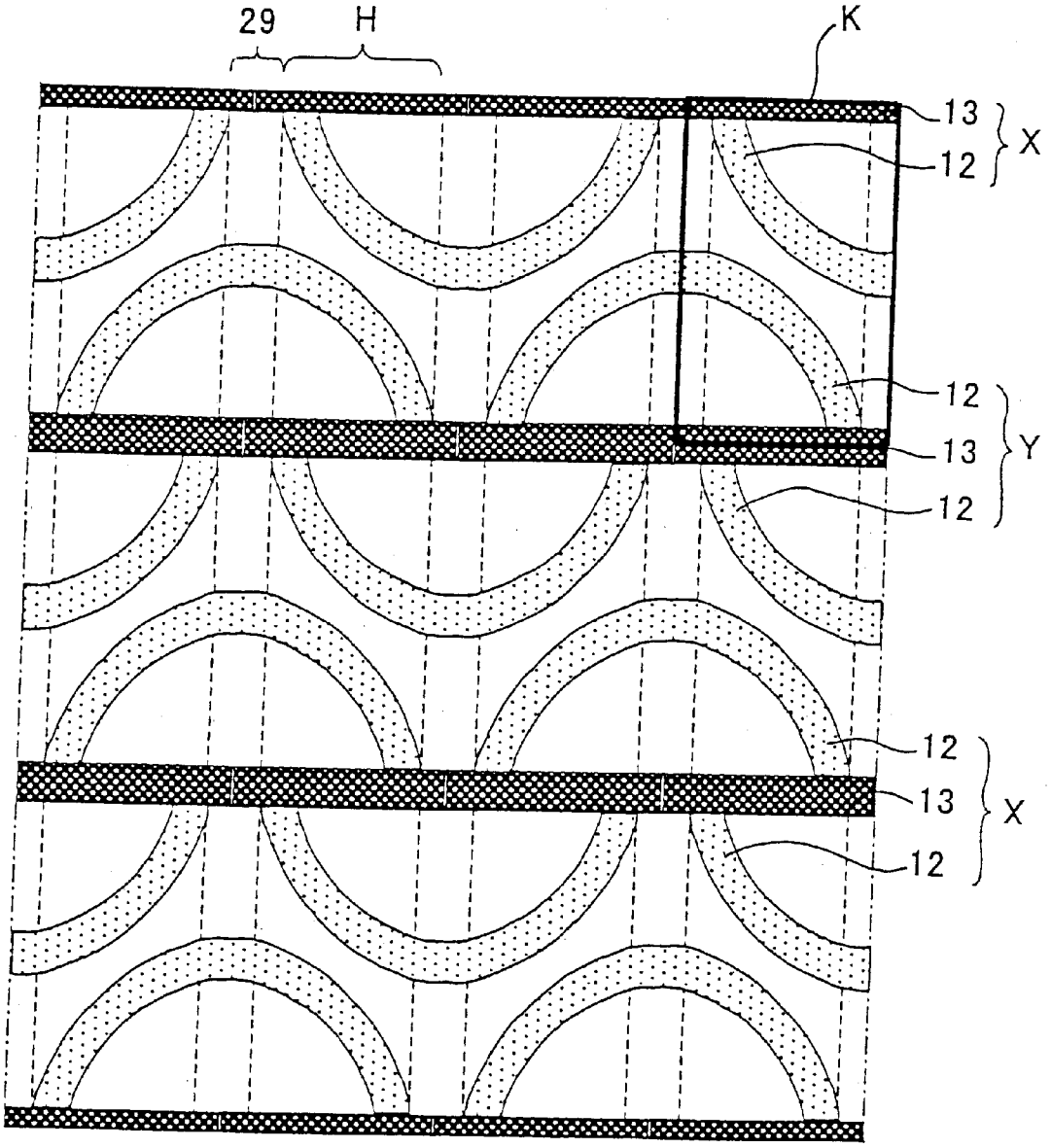
FIG. 17 is a diagram illustrating the electrode structure according to Embodiment 5.

FIGS. 16 and 17 are diagrams illustrating an electrode structure according to Embodiment 5. In this embodiment, display electrodes X, Y each have substantially the same construction as in Embodiment 4, except that curved branch electrodes 12 obliquely extending from the bus electrode 13 in each adjacent pair of unit discharge sections K arranged in a row are connected to each other. In this case, there are two possible arrangements of the branch electrodes 12 as shown in FIGS. 16 and 17, which are different in the extending directions of the branch electrodes 12 in each adjacent pair of cells arranged in a column. The arrangements of the branch electrodes 12 shown in FIGS. 16 and 17 are substantially the same as the arrangements shown in FIGS. 12 and 13, respectively. As in the second modification of Embodiment 1, the branch electrode 12 may have a branch portion extending along the non-discharge region 29 to be connected to the bus electrode 13.

Figure 18:
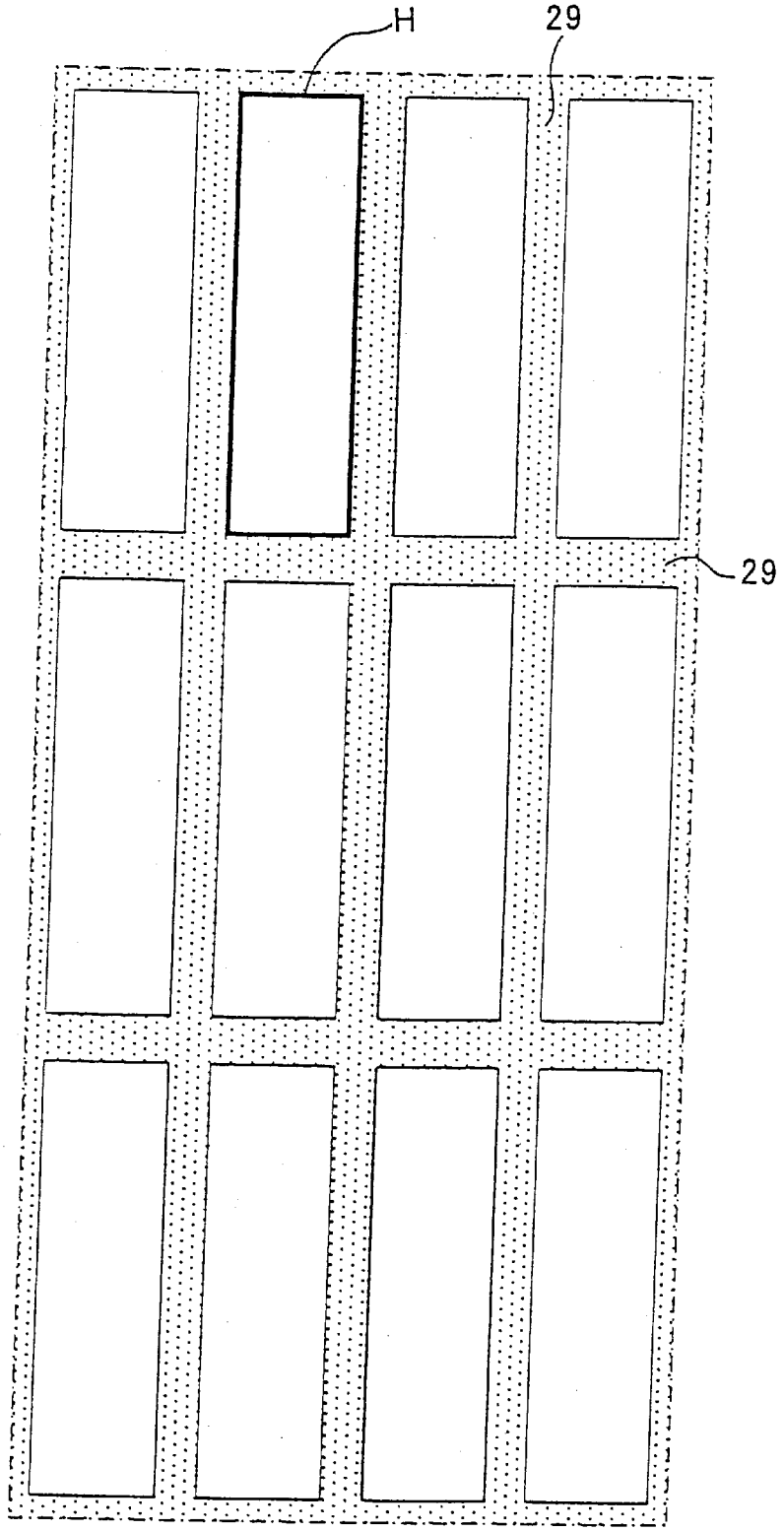
FIG. 18 is a diagram illustrating a first exemplary grid-shaped non-discharge region in accordance with an embodiment of the present invention.
Figure 19:
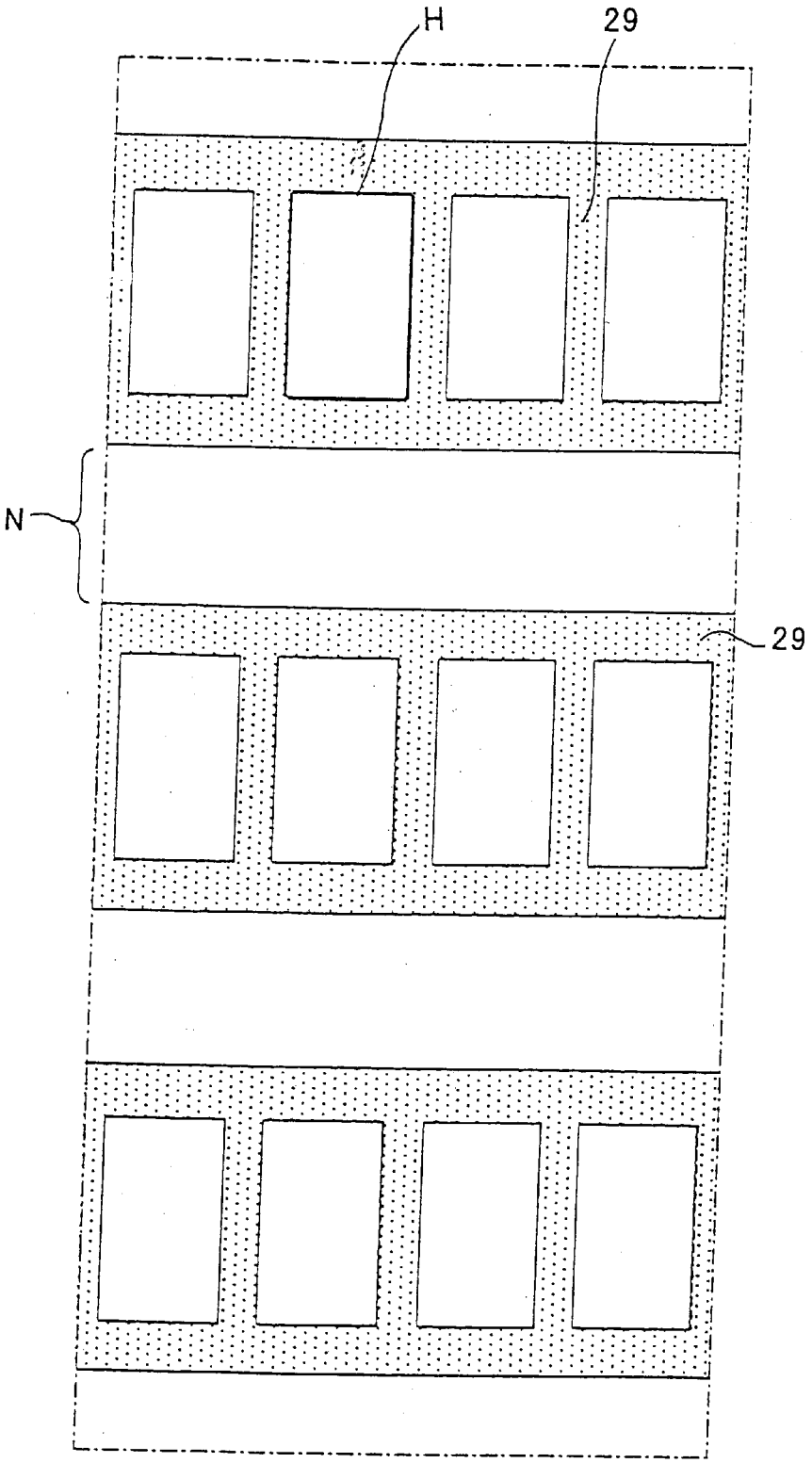
FIG. 19 is a diagram illustrating a second exemplary grid-shaped non-discharge region in accordance with an embodiment of the present invention.

FIGS. 18 and 19 are diagrams illustrating first and second exemplary grid-shaped non-discharge regions (barrier ribs). As shown, barrier ribs are provided in a grid-shaped non-discharge region to partition the discharge space in rows and columns. Where the discharge space is partitioned in rows and columns by the barrier ribs, the discharge regions H are defined as shown in FIG. 18 or in FIG. 19.

Embodiment 6

Figure 20:
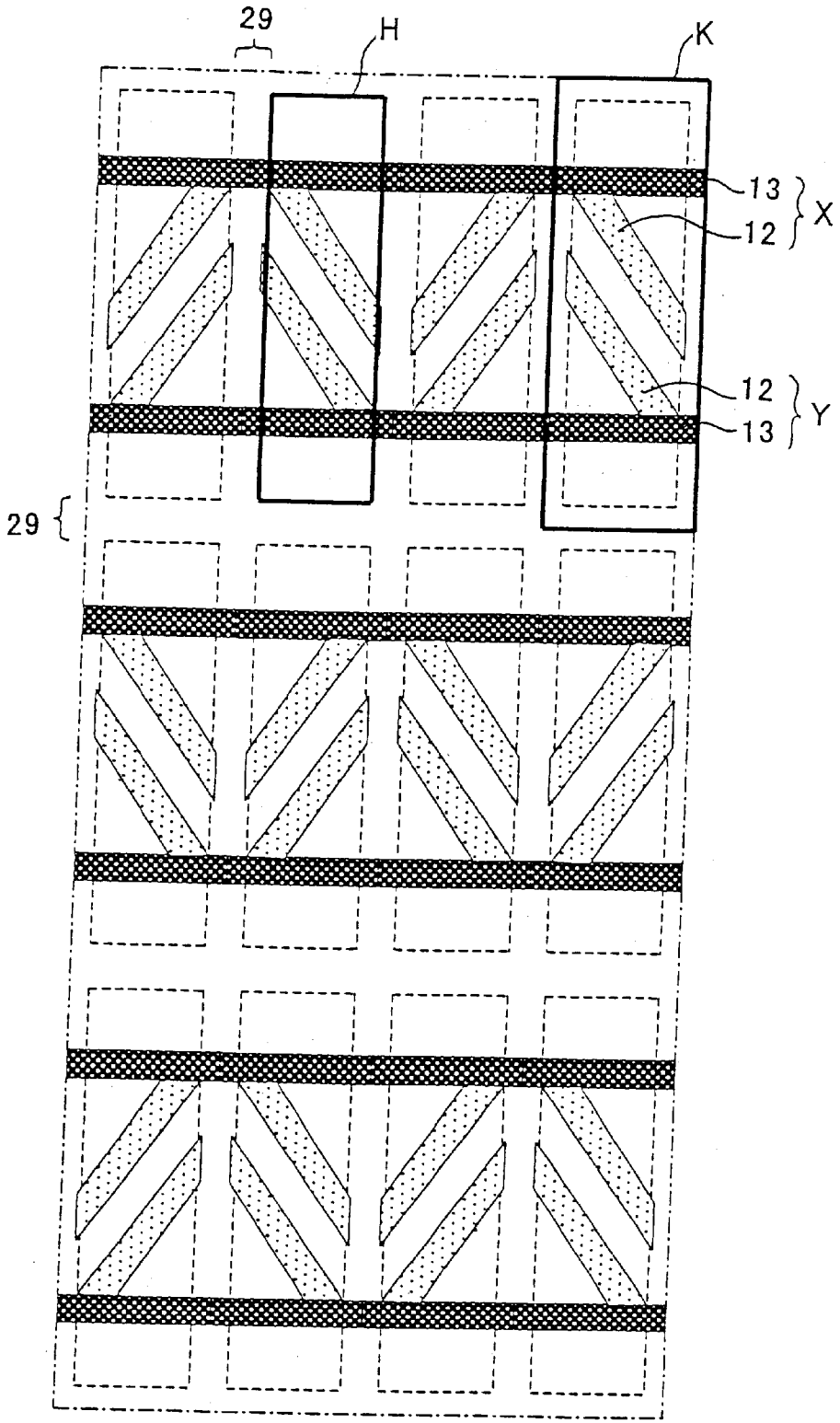
FIG. 20 is a diagram illustrating an electrode structure according to Embodiment 6 of the present invention.
Figure 21:
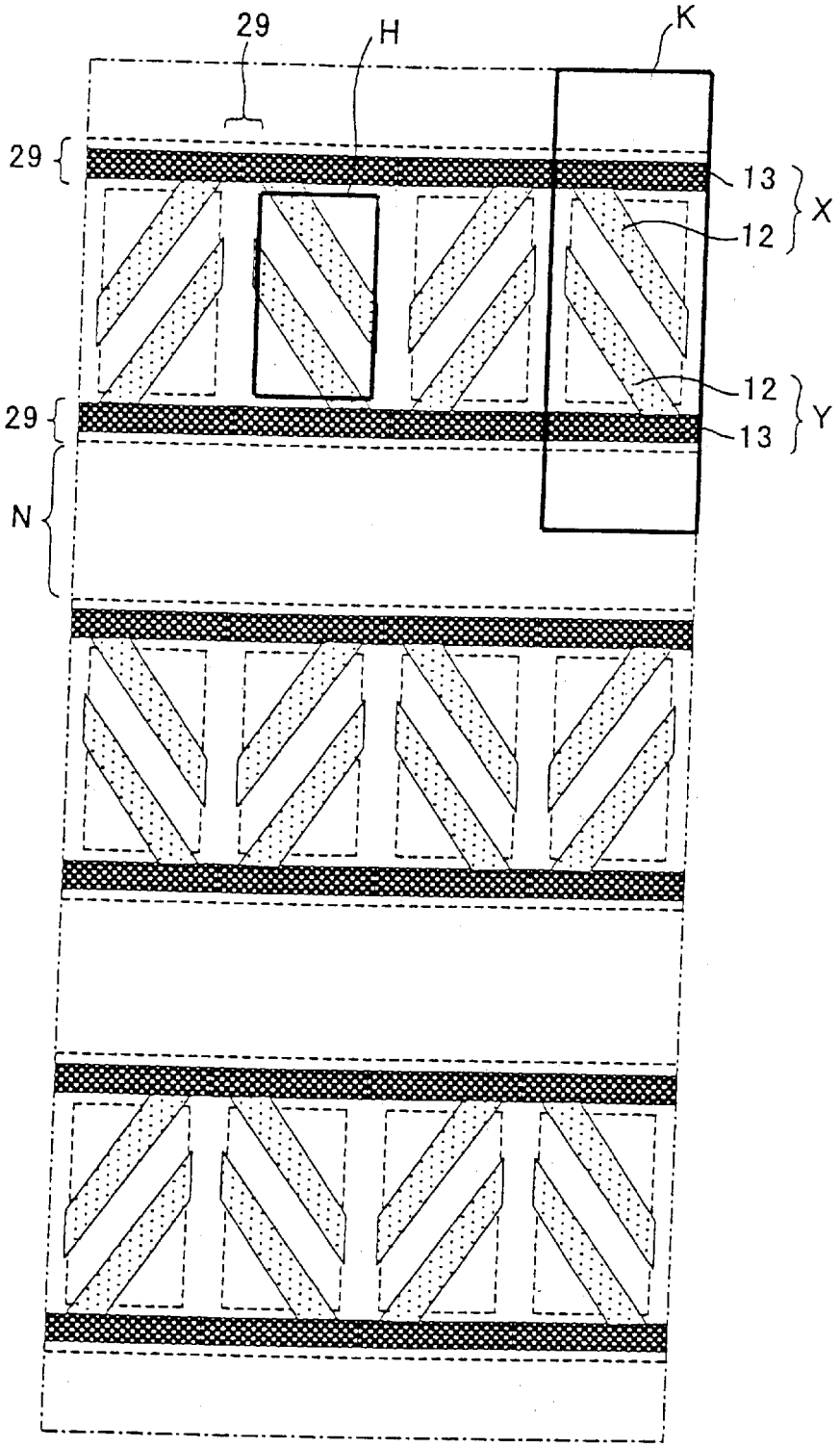
FIG. 21 is a diagram illustrating the electrode structure according to Embodiment 6.

FIGS. 20 and 21 are diagrams illustrating an electrode structure according to Embodiment 6. In FIG. 20, the discharge regions H are separated by the first exemplary grid-shaped non-discharge region 29. In FIG. 21, the discharge regions H are separated by the second exemplary grid-shaped non-discharge region 29. In this embodiment, display electrodes X, Y each have the same construction as in Embodiment 1 shown in FIG. 1. That is, the barrier rib arrangements shown in FIGS. 18 and 19 are each employed in combination with the electrode structure of Embodiment 1 to separate the discharge regions H by the grid-shaped non-discharge region 29.

Modification of Embodiment 6

Figure 22:
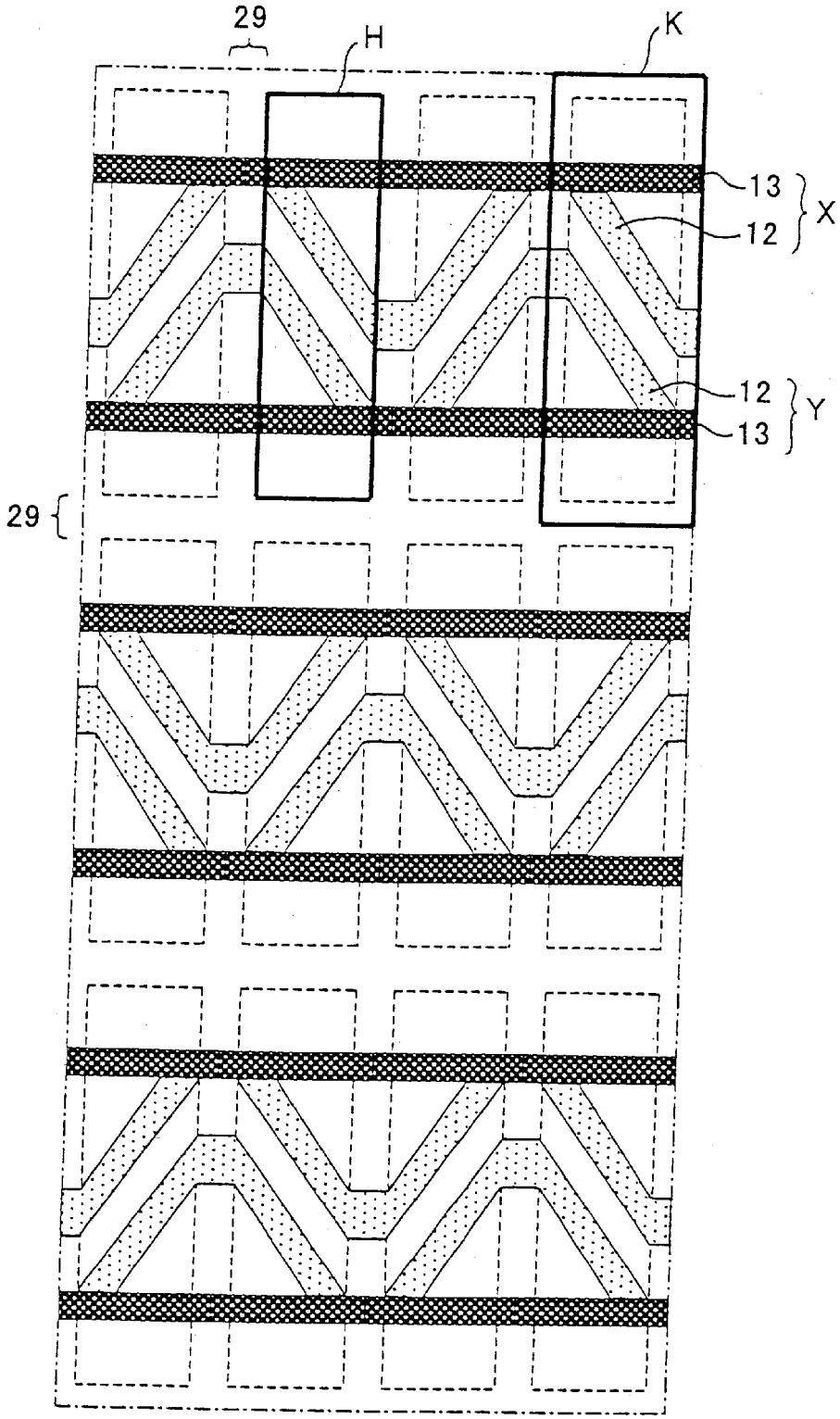
FIG. 22 is a diagram illustrating a modification of Embodiment 6.
Figure 23:
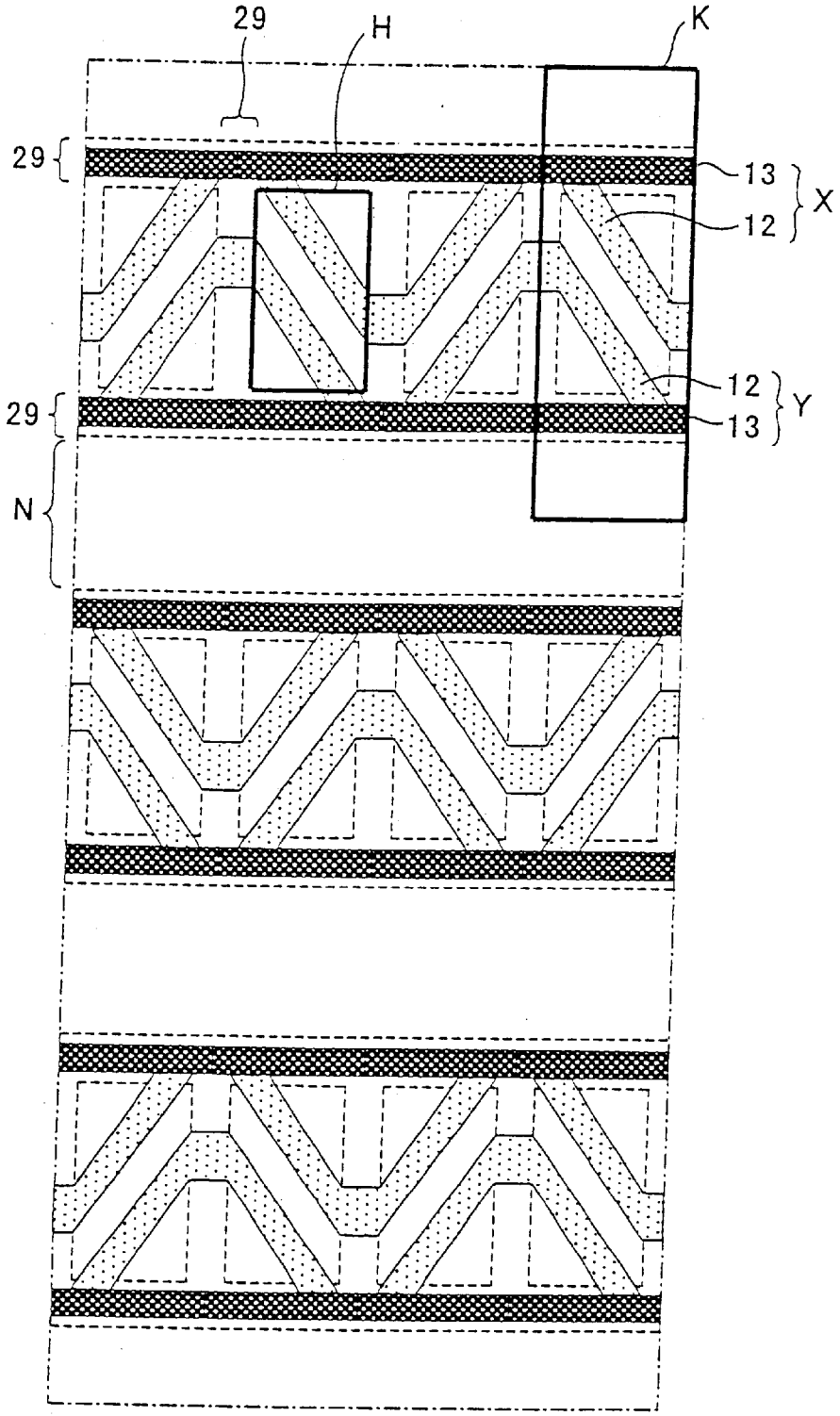
FIG. 23 is a diagram illustrating another modification of Embodiment 6.

FIGS. 22 and 23 are diagrams illustrating a modification of Embodiment 6. In the modification of Embodiment 6, the display electrodes X, Y each have substantially the same construction as in Embodiment 6, except that branch electrodes 12 obliquely extending from the bus electrode 13 in each adjacent pair of unit discharge sections K arranged in a row are connected to each other. As in the second modification of Embodiment 1, the branch electrode 12 may have a branch portion extending along the non-discharge region 29 to be connected to the bus electrode 13.

Embodiment 7

Figure 24:
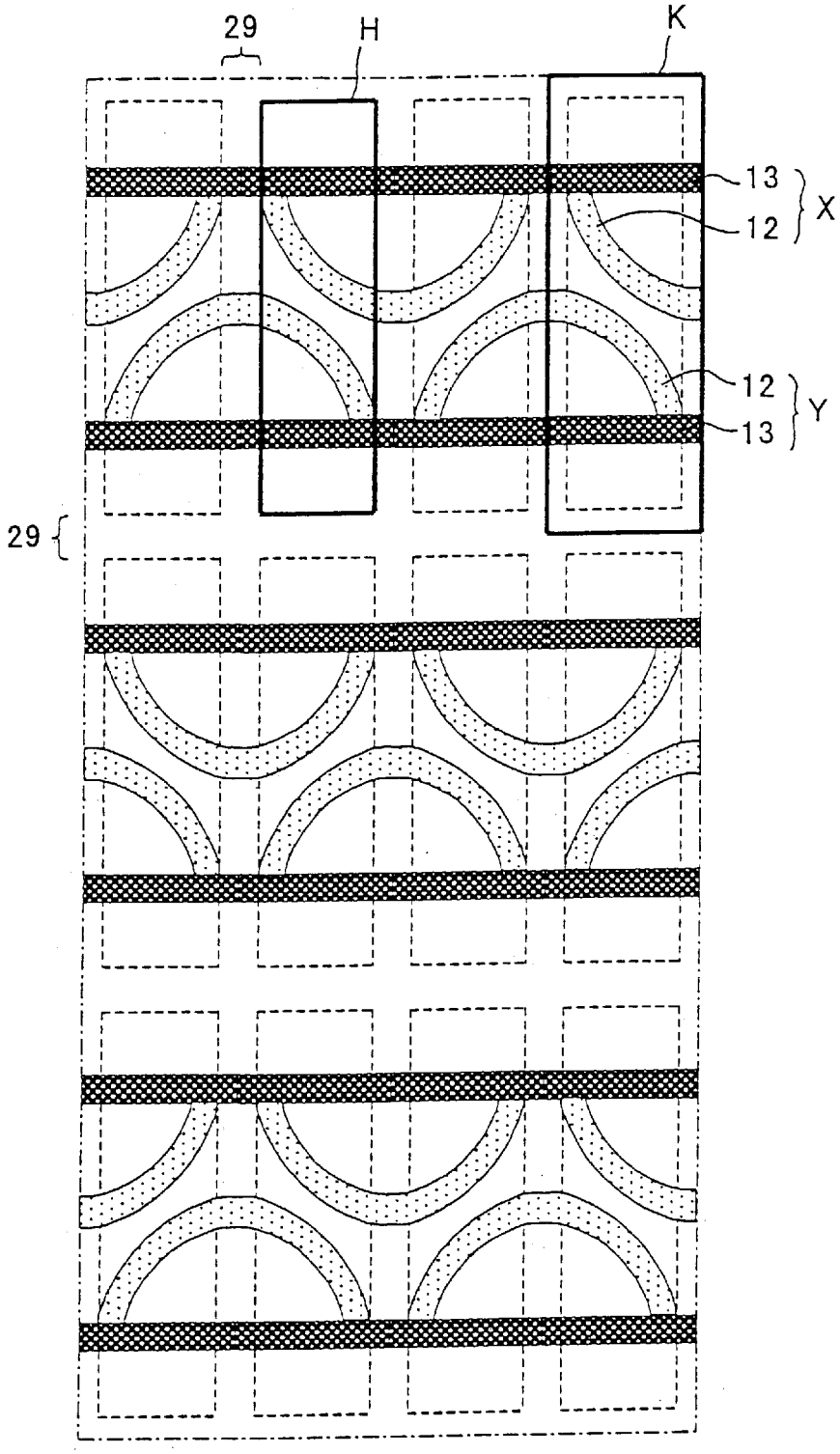
FIG. 24 is a diagram illustrating an electrode structure according to Embodiment 7 of the present invention.
Figure 25:
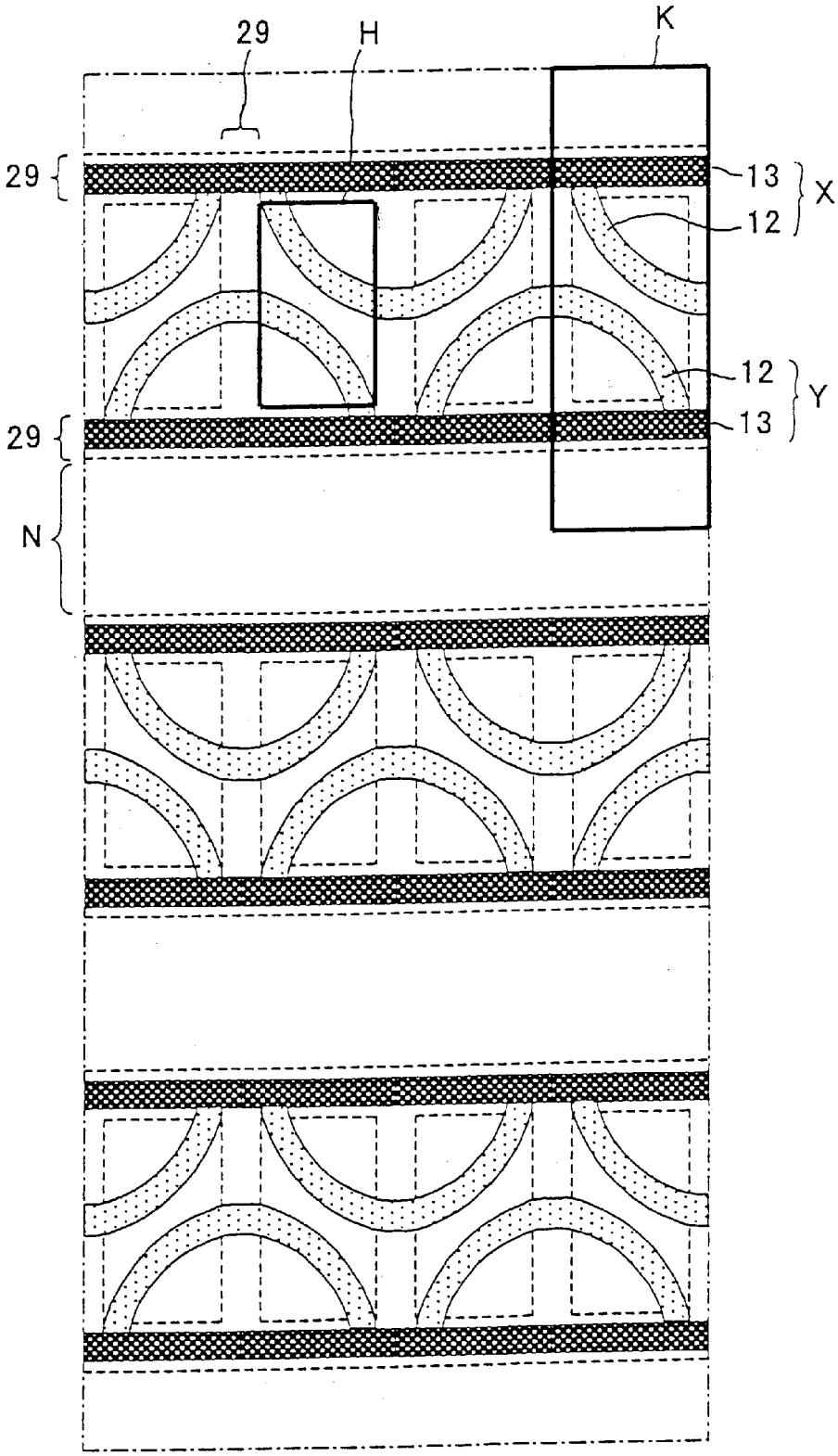
FIG. 25 is a diagram illustrating the electrode structure according to Embodiment 7.

FIGS. 24 and 25 are diagrams illustrating an electrode structure according to Embodiment 7. In FIG. 24, discharge regions H are separated by the first exemplary grid-shaped non-discharge region 29. In FIG. 25, discharge regions H are separated by the second exemplary grid-shaped non-discharge region 29. In this embodiment, display electrodes X, Y each have substantially the same construction as in Embodiment 6, except that curved branch electrodes 12 obliquely extending from the bus electrode 13 in each adjacent pair of unit discharge sections K arranged in a row are connected to each other. As in the second modification of Embodiment 1, the branch electrode 12 may have a branch portion extending along the non-discharge region 29 to be connected to the bus electrode 13.

Embodiment 8

Figure 26:
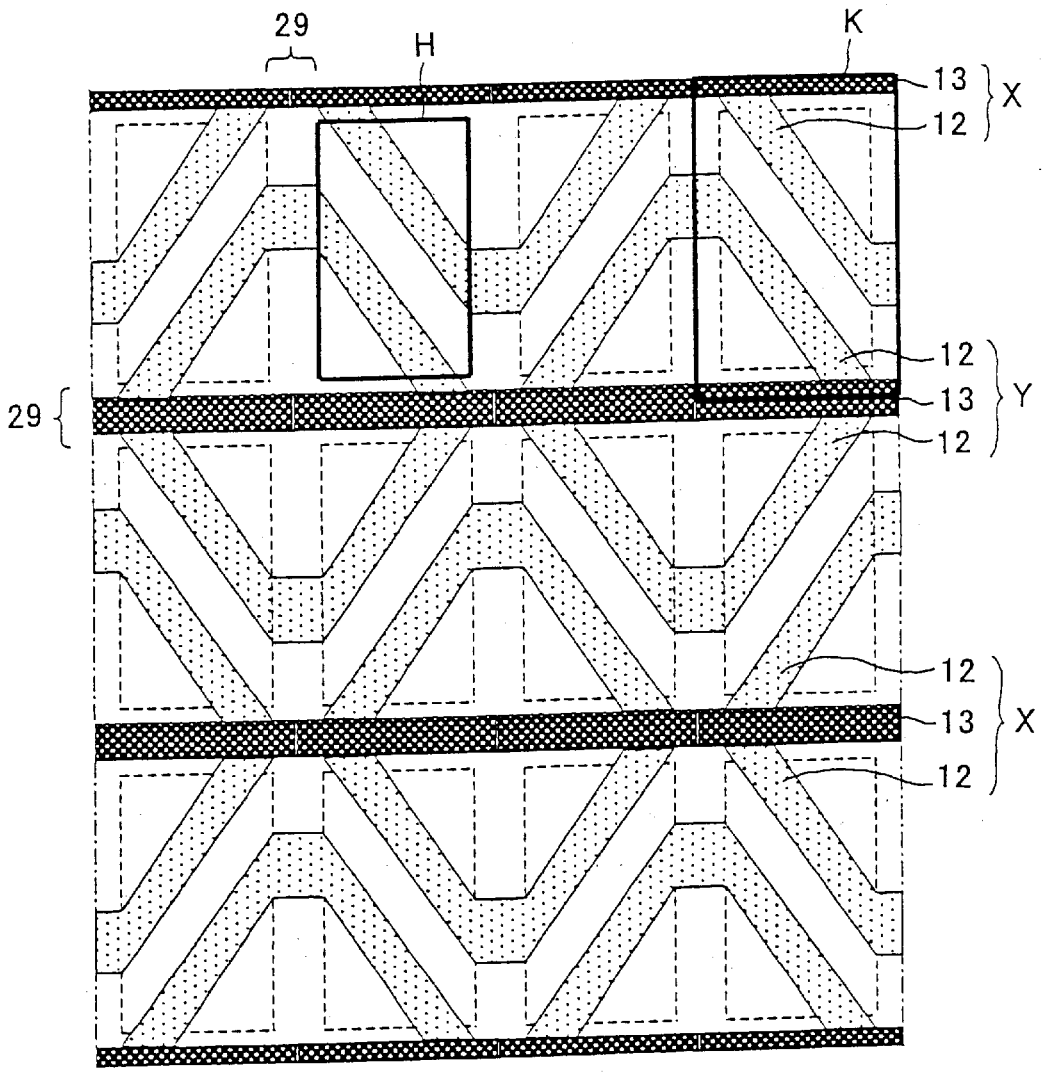
FIG. 26 is a diagram illustrating an electrode structure according to Embodiment 8 of the present invention.

FIG. 26 is a diagram illustrating an electrode structure according to Embodiment 8. In this embodiment, discharge regions H are separated by the first exemplary grid-shaped non-discharge region 29, and display electrodes X, Y each have substantially the same construction as in Embodiment 6, except that the bus electrode 13 is shared by an adjacent pair of cells arranged in a column and that branch electrodes 12 obliquely extending from the bus electrode 13 in each adjacent pair of unit discharge sections K arranged in a row are connected to each other.

In this electrode structure, the connection may be obviated as in Embodiment 4 shown in FIG. 12. As in the second modification of Embodiment 1, the branch electrode 12 may have a branch portion extending along the non-discharge region 29 to be connected to the bus electrode 13. In this case, there are two possible arrangements of the branch electrodes 12, as shown in FIGS. 14 and 15 in Embodiment 4, which are different in the extending directions of the branch electrodes 12 in each adjacent pair of cells arranged in a column.

Embodiment 9

Figure 27:
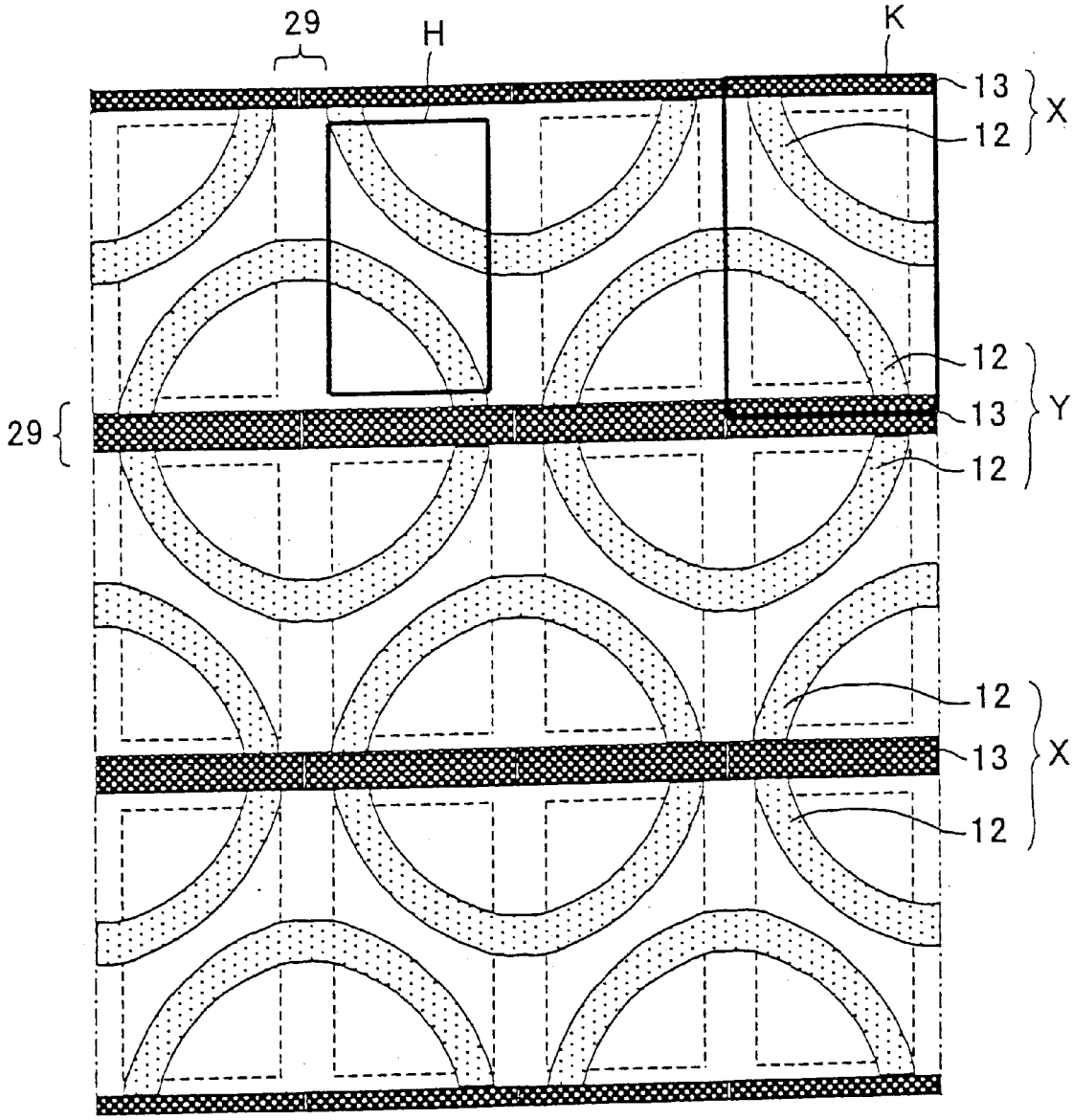
FIG. 27 is a diagram illustrating an electrode structure according to Embodiment 9 of the present invention.

FIG. 27 is a diagram illustrating an electrode structure according to Embodiment 9. In this embodiment, discharge regions H are separated by the first exemplary grid-shaped non-discharge region 29, and display electrodes X, Y each have substantially the same construction as in Embodiment 6, except that the bus electrode 13 is shared by an adjacent pair of cells arranged in a column and that curved branch electrodes 12 obliquely extending from the bus electrode 13 in each adjacent pair of unit discharge sections K arranged in a row are connected to each other.

In this electrode structure, the connection may be obviated. As in the second modification of Embodiment 1, the branch electrode 12 may have a branch portion extending along the non-discharge region 29 to be connected to the bus electrode 13. In this case, there are two possible arrangements of the branch electrodes 12, as shown in FIGS. 16 and 17 in Embodiment 5, which are different in the extending directions of the branch electrodes 12 in each adjacent pair of cells arranged in a column.

Embodiment 10

Figure 28:
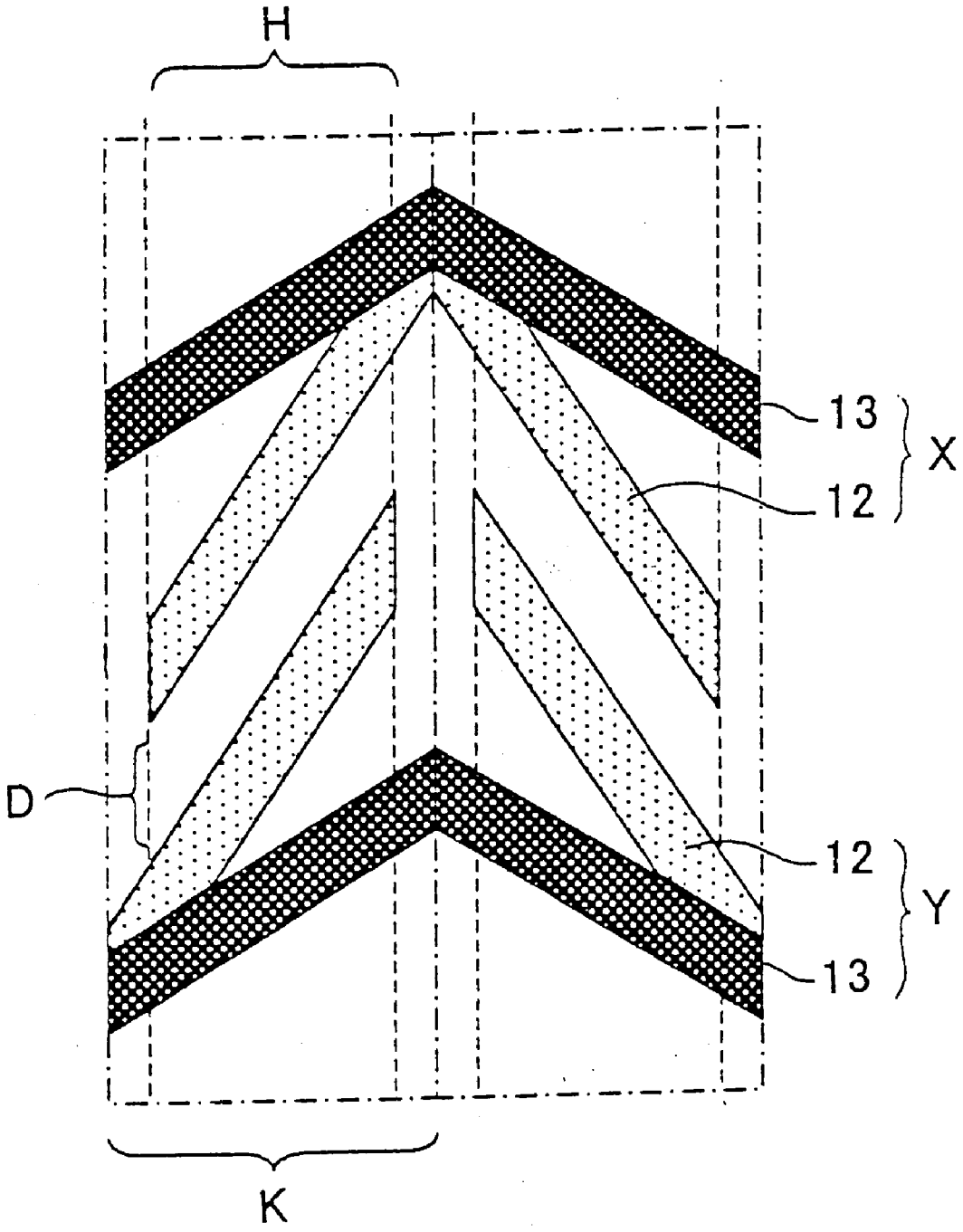
FIG. 28 is a diagram illustrating an electrode structure according to Embodiment 10 of the present invention.

FIG. 28 is a diagram illustrating an electrode structure according to Embodiment 10. In this embodiment, display electrodes X, Y each have substantially the same construction as in Embodiment 1, except that the bus electrode 13 has a chevron shape with its crest located in the non-discharge region. More specifically, the bus electrode 13 is skewed with respect to a row of the unit discharge sections K so as to form a smaller angle with respect to a longitudinal axis of the discharge gap D. The crest of the chevron-shaped bus electrode 13 may be located in the vicinity of a boundary of each adjacent pair of unit discharge sections K arranged in a row, as long as the bus electrode 13 is skewed. Even with this arrangement, it is possible to keep the bus electrode 13 away from the discharge gap D.

In the electrode structure, branch electrodes 12 in each adjacent pair of cells arranged in a row may be connected to each other in the non-discharge region. The branch electrode 12 may have a branch portion extending along the non-discharge region 29 to be connected to the bus electrode 13. Further, the branch electrode 12 may be curved (arcuate).

Embodiment 11

Figure 29:
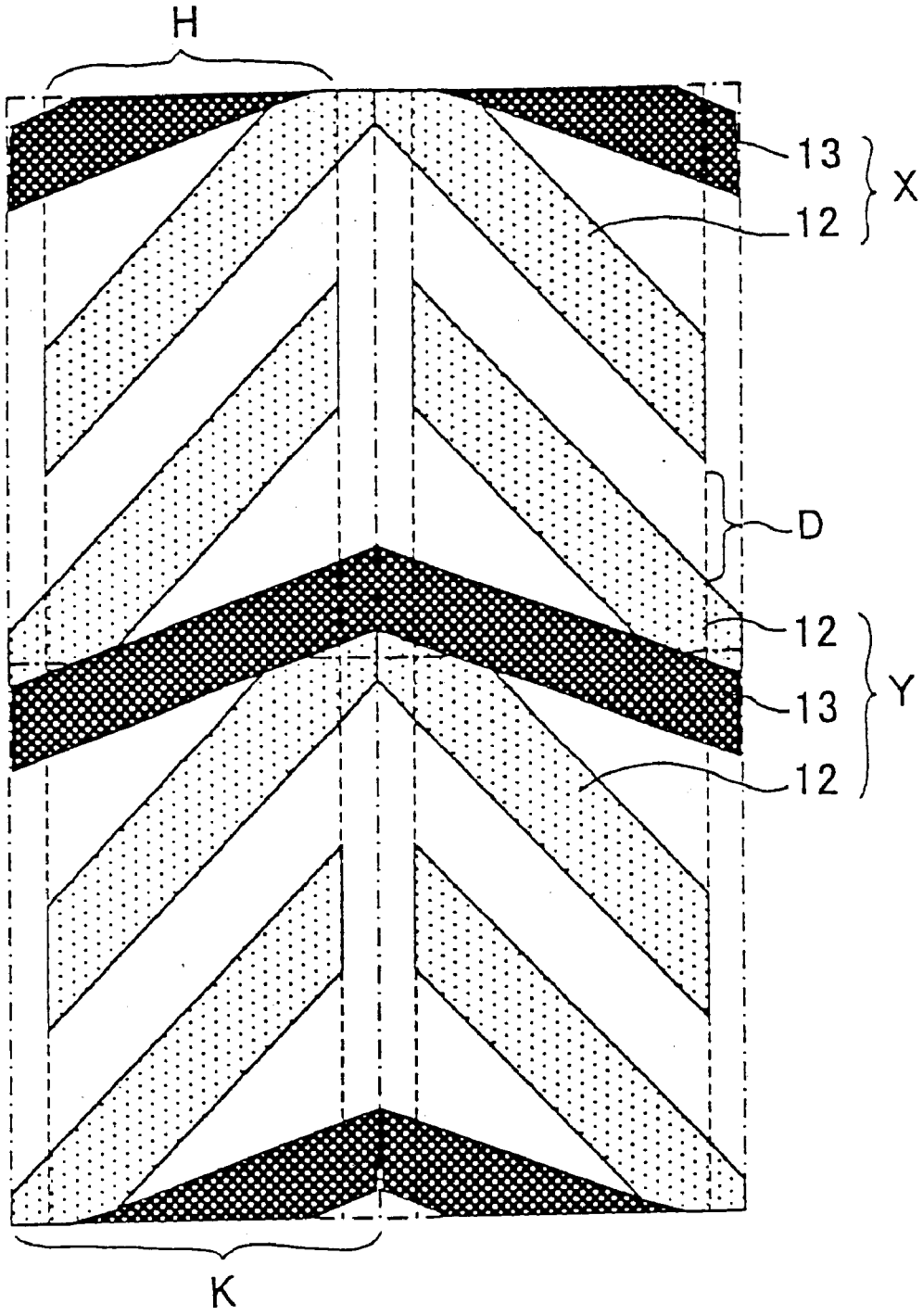
FIG. 29 is a diagram illustrating an electrode structure according to Embodiment 11 of the present invention.

FIG. 29 is a diagram illustrating an electrode structure according to Embodiment 11. In this embodiment, display electrodes X, Y each have substantially the same construction as in Embodiment 10, except that the bus electrode 13 is shared by an adjacent pair of cells arranged in a column. The bus electrode 13 has a chevron shape to provide the same effect as in Embodiment 10.

While the electrode structures of the display electrodes X, Y have thus been described, an explanation will next be given to address electrode structures.

Figure 30:
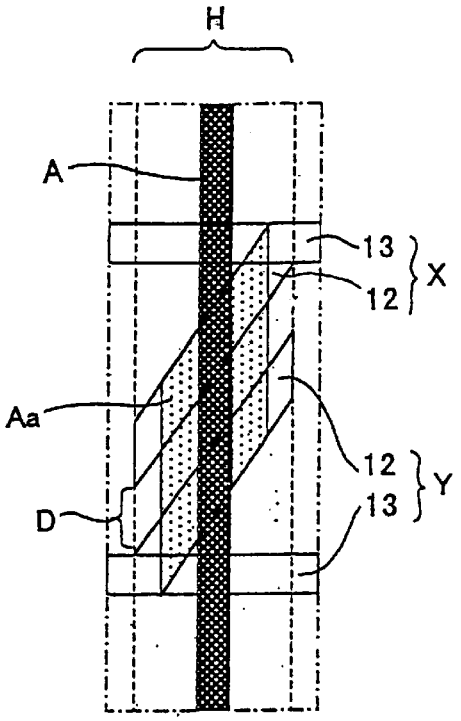
FIG. 30 is a diagram illustrating a first modification of the address electrode structure in accordance with an embodiment of the present invention.

FIG. 30 is a diagram illustrating a first modification of the address electrode structure. In the first modification, the address electrode A has a branch address electrode Aa which is generally conformal to a total configuration of the branch electrodes 12 of the display electrodes X, Y and the discharge gap D. More specifically, the branch address electrode Aa extend from the address electrode A in opposite directions along the branch electrodes 12. The address electrode A and the branch address electrode Aa are formed of a thin metal film. With this arrangement, a mating surface area of the opposed electrodes is increased as compared with the address electrode structure shown in FIG. 2, so that the opposed discharge can more reliably be induced during the reset period.

With this address electrode structure, an inter-line capacitance between each adjacent pair of address electrodes is increased and, therefore, the branch address electrode Aa should have a proper length. In a production process of the PDP, positioning of the two (front and rear) substrates inevitably suffers from a positioning error. Therefore, the branch address electrode Aa preferably has a width greater than a distance between distal edges of the branch electrodes as viewed in plan. Further, the branch address electrode Aa is not necessarily required to extend in exactly the same direction as the branch electrodes 12.

Figure 31:
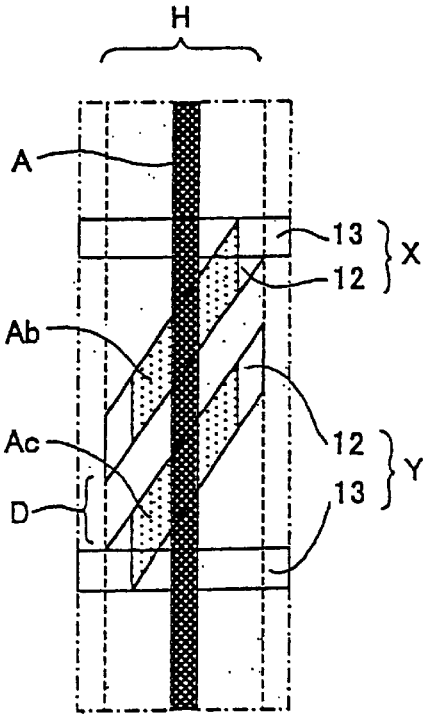
FIG. 31 is a diagram illustrating a second modification of the address electrode structure in accordance with an embodiment of the present invention.

FIG. 31 is a diagram illustrating a second modification of the address electrode structure. In the second modification, the address electrode A has substantially the same construction as in the first modification shown in FIG. 30, but has separate branch address electrodes Ab and Ac which are generally conformal to the respective branch electrodes 12.

With this address electrode structure, needless charge accumulation in the discharge gap D can be prevented, so that the inter-line capacitance between each adjacent pair of address electrodes can be reduced without deterioration in the reliability of the opposed discharge.

Figure 32:
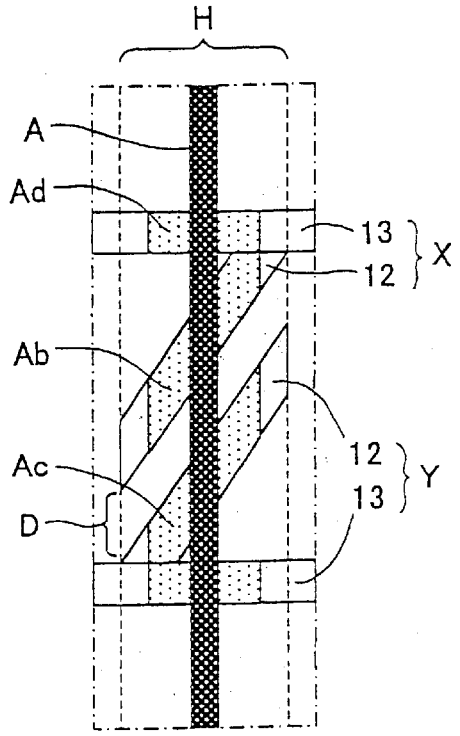
FIG. 32 is a diagram illustrating a third modification of the address electrode structure in accordance with an embodiment of the present invention.

FIG. 32 is a diagram illustrating a third modification of the address electrode structure. In the third modification, the address electrode A has branch address electrodes Ab and Ac as in the second modification shown in FIG. 31 and, in addition, branch address electrodes Ad overlapping the bus electrodes 13 as viewed in plan. That is, the branch address electrodes Ab and Ac are provided in an opposed relation to the branch electrodes 12, and the branch address electrodes Ad extend along the bus electrodes 13 in an opposed relation thereto. With this address electrode structure, wall charges are accumulated on the bus electrodes 13, so that the cell initialization can more reliably be performed.

Figure 33:
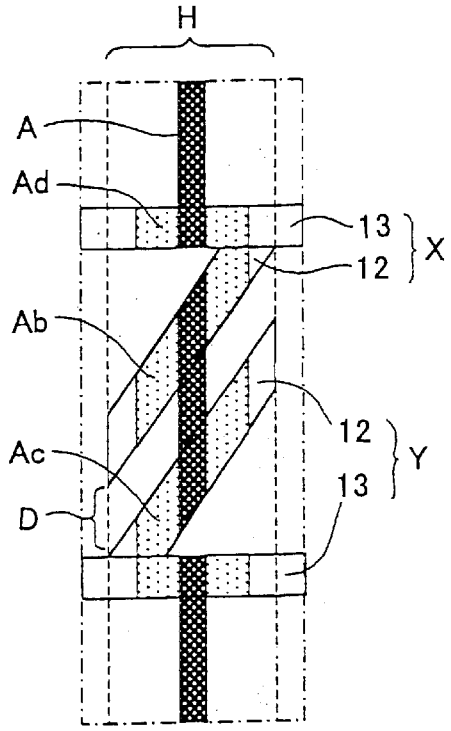
FIG. 33 is a diagram illustrating a fourth modification of the address electrode structure in accordance with an embodiment of the present invention.

FIG. 33 is a diagram illustrating a fourth modification of the address electrode structure. In the fourth modification, the address electrode A has substantially the same construction as in the third modification shown in FIG. 32, except that bypass portions thereof are eliminated. That is, the bypass portions which are not opposed to the bus electrodes 13 nor to the branch electrodes 12 in the vicinity of junctures between the branch address electrodes Ad and the branch address electrodes Ab, Ac are eliminated. With this address electrode structure, the address electrode A has a reduced area, so that the inter-line capacitance between each adjacent pair of address electrodes can be reduced.

Figure 34:
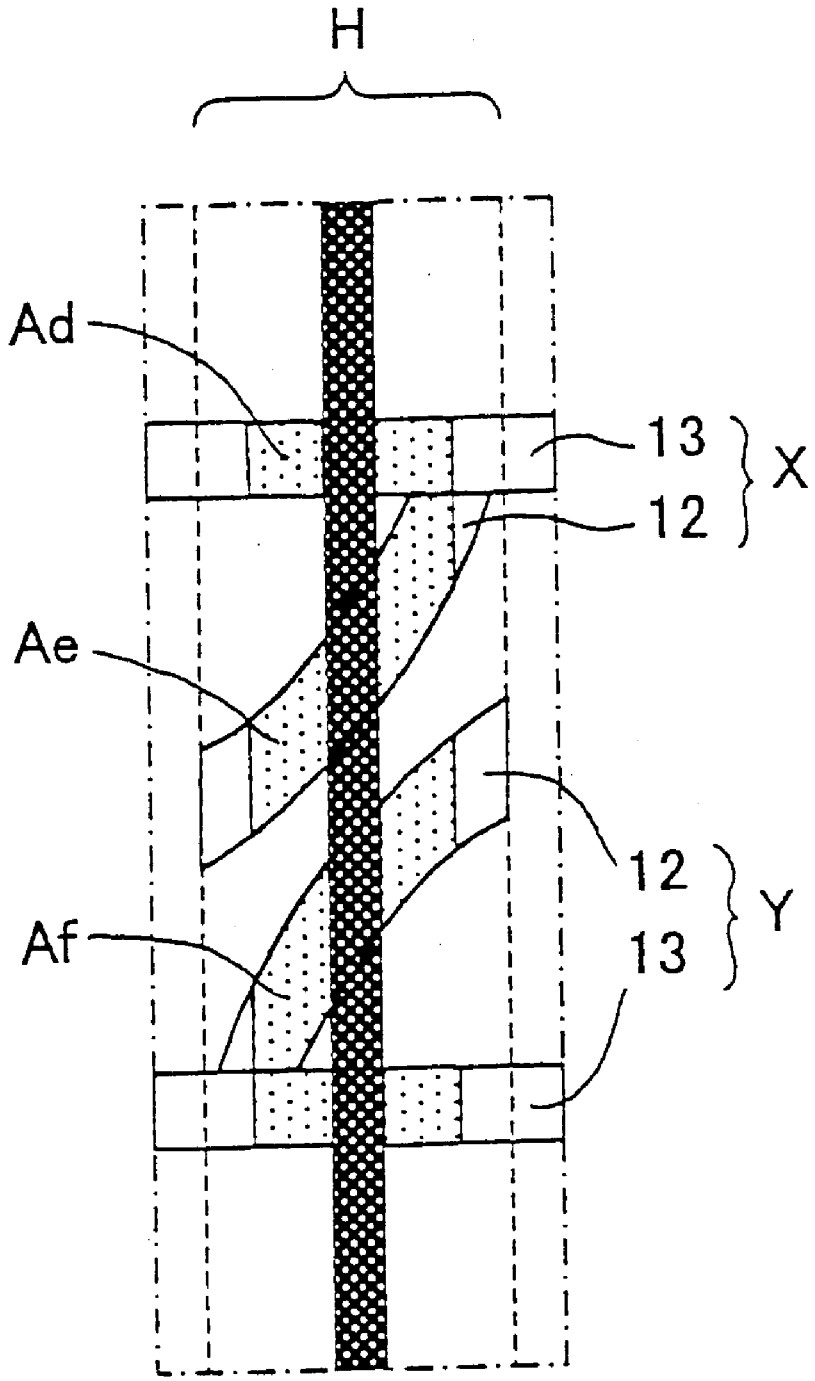
FIG. 34 is a diagram illustrating a fifth modification of the address electrode structure in accordance with an embodiment of the present invention.
Figure 35:
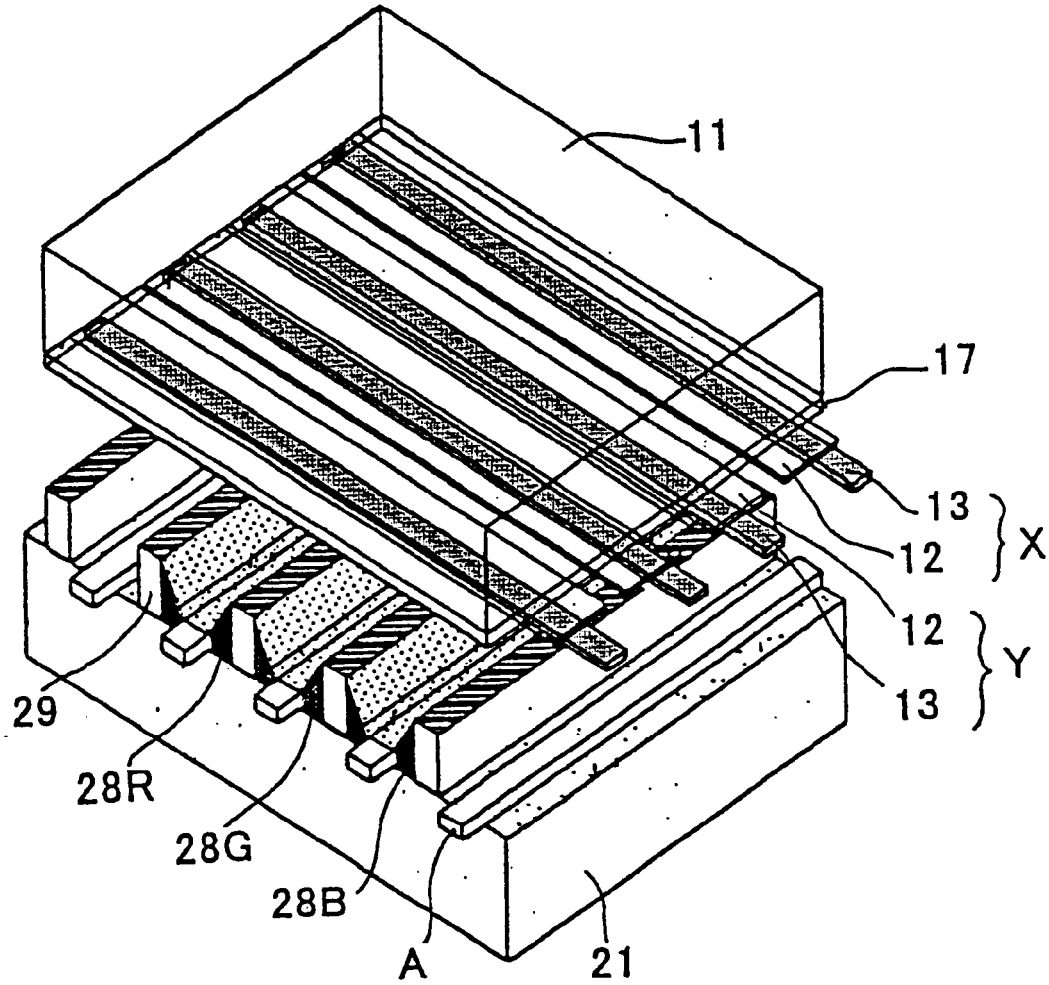
FIG. 35 PRIOR ART
FIG. 35 is a perspective view illustrating a part of a conventional AC-driven three-electrode surface discharge PDP for color display.
Figure 36:
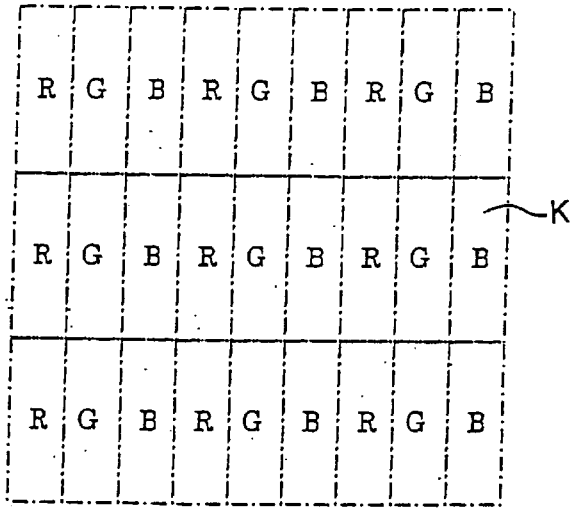
FIG. 36 PRIOR ART
FIG. 36 is a diagram illustrating unit discharge sections arranged in a grid pattern in the PDP of FIG. 35 as viewed in plan.
Figure 37:
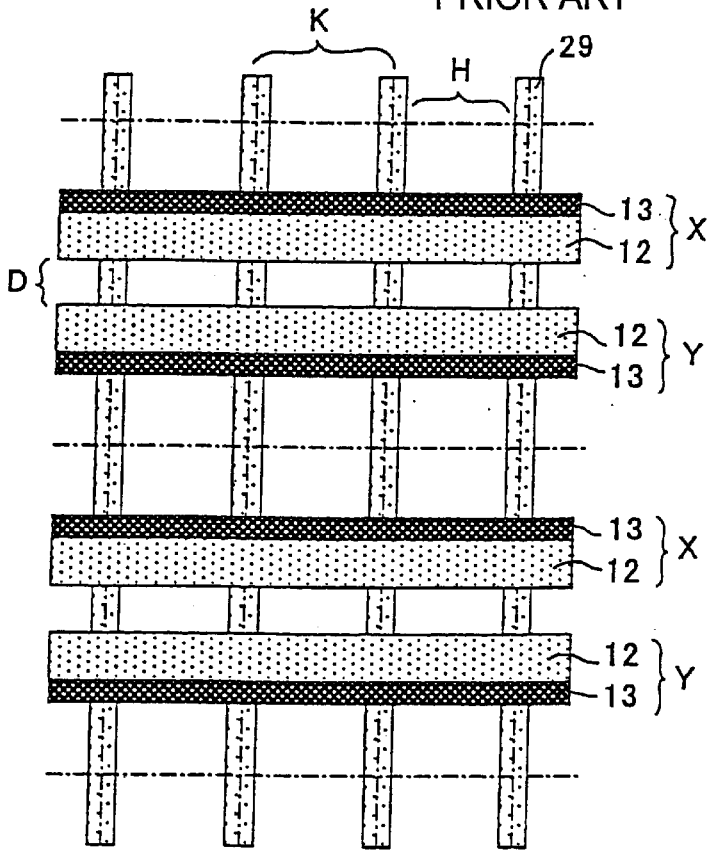
FIG. 37 PRIOR ART
FIG. 37 is a diagram illustrating a positional relationship between unit discharge sections and display electrodes of the PDP of FIG. 35 as viewed in plan.
Figure 38:
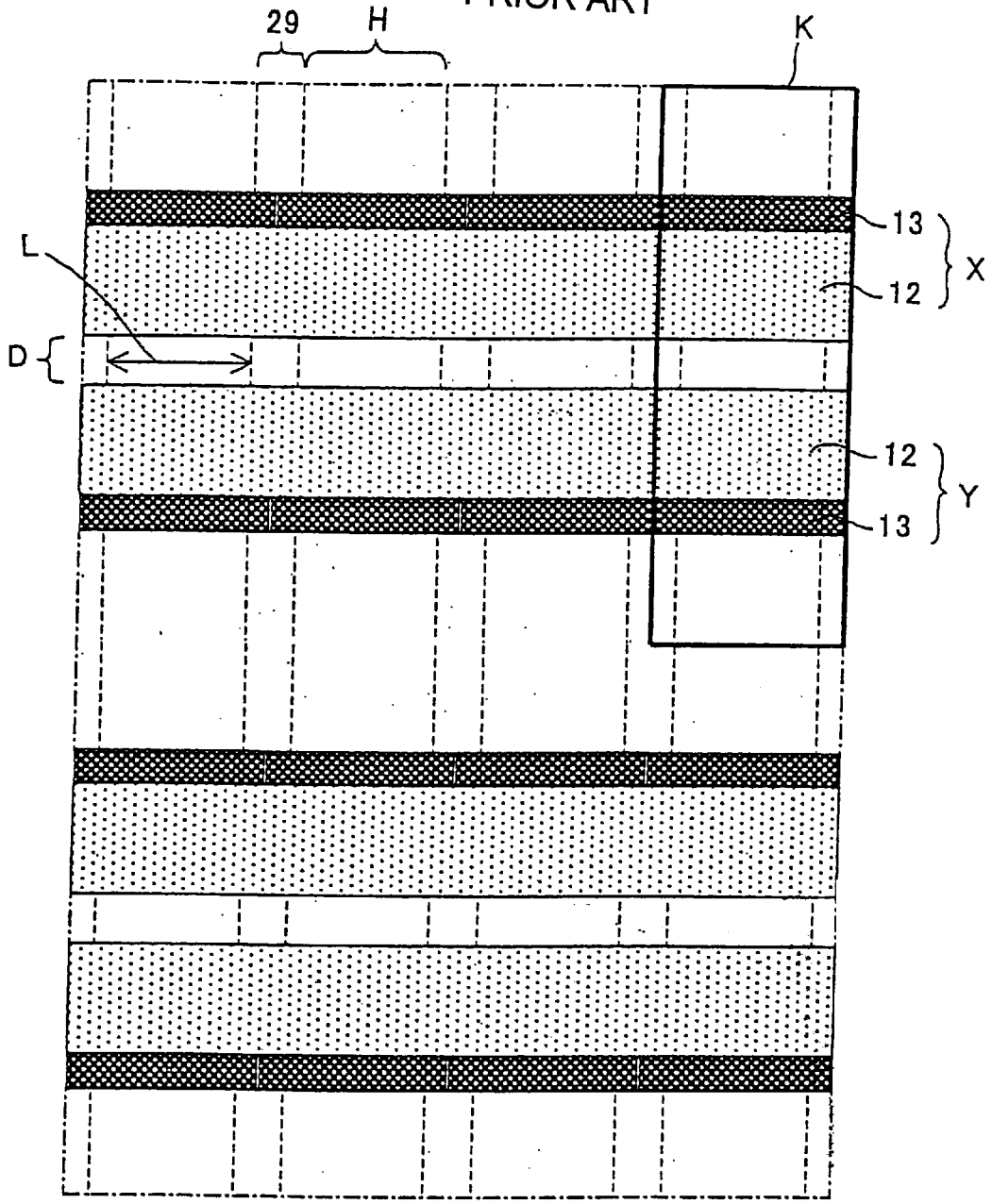
FIG. 38 PRIOR ART
FIG. 38 is a diagram illustrating an electrode structure of the PDP of FIG. 35 as viewed in plan.
Figure 39:
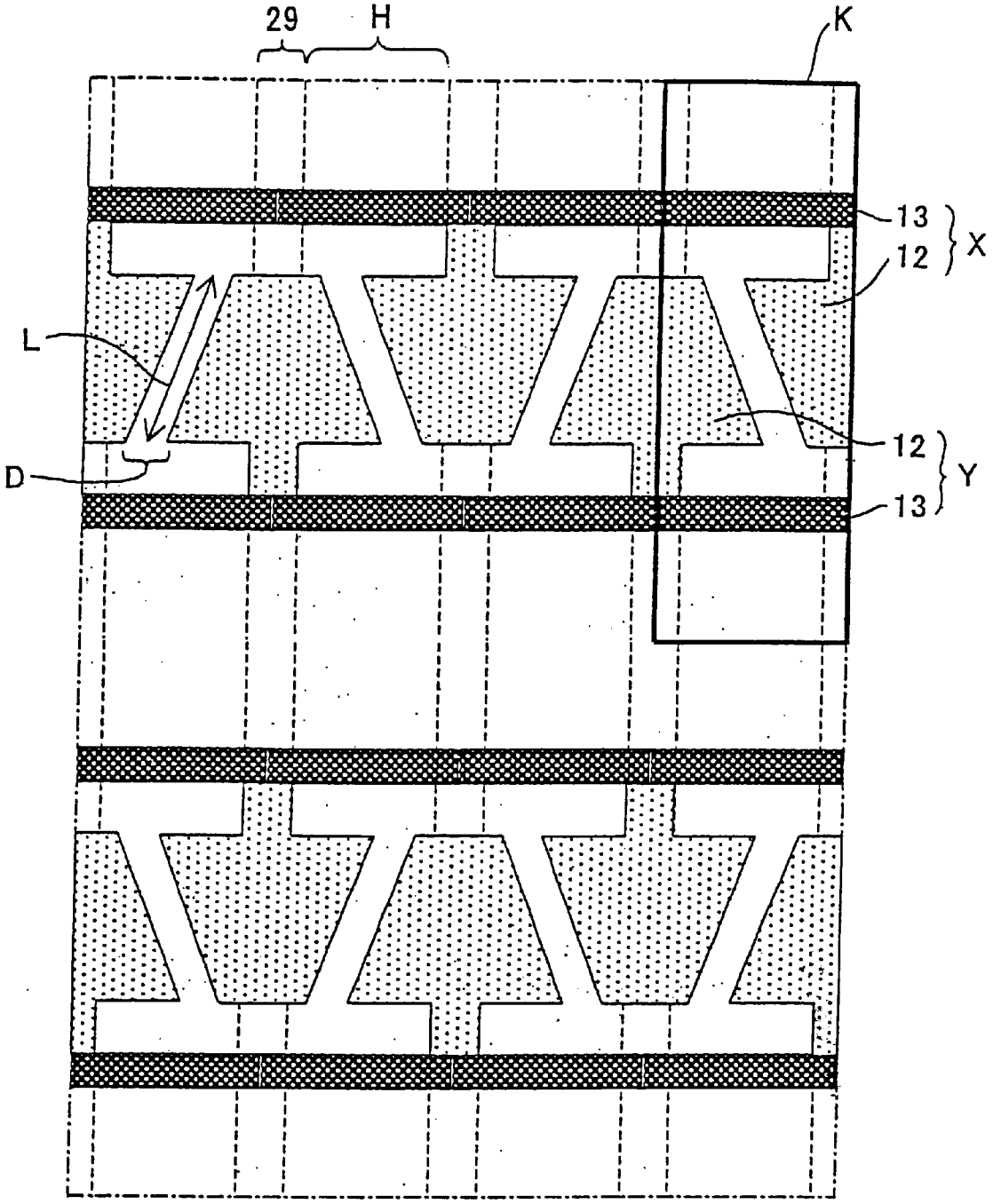
FIG. 39 PRIOR ART
FIG. 39 is a diagram illustrating one example of a conventional electrode structure in which discharge gaps are skewed with respect to the unit discharge sections.
Figure 40:
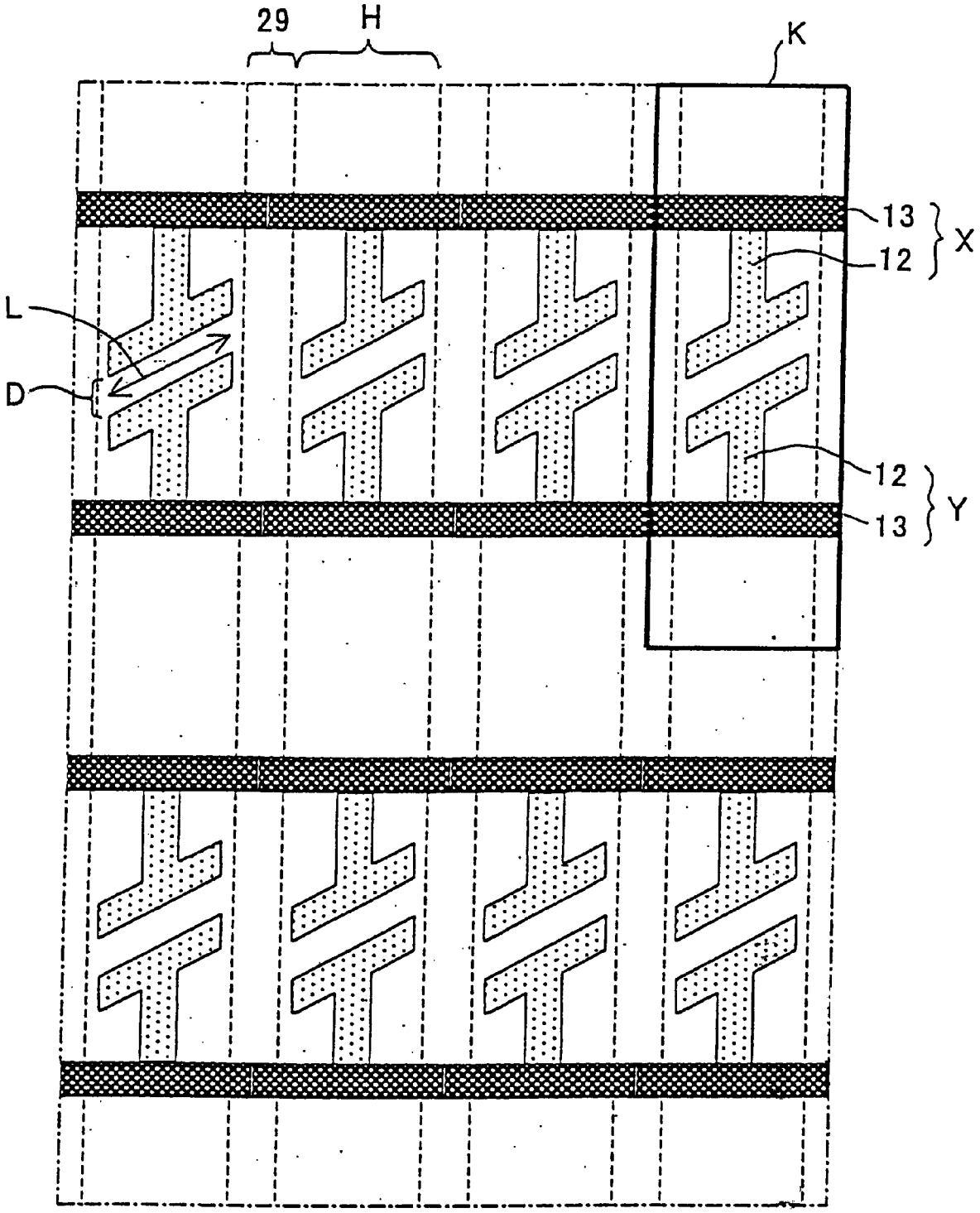
FIG. 40 PRIOR ART
FIG. 40 is a diagram illustrating another example of the conventional electrode structure in which the discharge gaps are skewed with respect to the unit discharge sections.

FIG. 34 is a diagram illustrating a fifth modification of the address electrode structure. The address electrode structure according to the fifth modification is employed where the branch electrodes 12 of the display electrodes X, Y are each curved. The address electrode structure according to the third modification shown in FIG. 32 is modified so that the branch address electrodes are generally conformal to the curved branch electrodes 12. Where the branch electrodes 12 are curved, the branch address electrodes are also curved as indicated by reference characters Ae and Af.

As described above, the display electrodes are constructed such that the branch electrodes thereof each having a constant width have neither a branch nor an end within the discharge region and respectively extend from the bus electrodes to define the skewed discharge gap therebetween, whereby the branch electrodes do not have an area remote from the discharge gap. This prevents the reduction in the luminous intensity for improvement of the luminous efficiency.

In the embodiments described above, the inventive electrode structure is applied to the PDP having the pixel matrix array, but is applicable to PDPs having any other pixel arrangements such as a delta pixel arrangement as long as the unit discharge sections each have a generally rectangular shape. The unit discharge sections do not necessarily each correspond to a minimum light emitting unit. Further, the materials for the bus electrodes, the branch electrodes and the address electrodes are not limited to those described above. The embodiments described above may be employed in combination.

Thus, the present invention provides a plasma display panel which ensures a higher reliability and a higher luminous efficiency.

What is claimed is:

1. An electrode structure for a plasma display panel having a plurality of unit discharge sections arranged in a matrix array in a discharge space defined between a pair of substrates, the electrode structure comprising:

a pair of bus electrodes, and a pair of branch electrodes respectively extending from the bus electrodes in each of the unit discharge sections to define a discharge gap therebetween, wherein the bus electrodes each extend along a row of the matrix array of the unit discharge sections, and each of the branch electrodes has a generally constant width and obliquely extends across a discharge region in each of the unit discharge sections so that the discharge gap defined between the branch electrodes is skewed with respect to a column of the matrix array of the unit discharge sections.

2. An electrode structure as set forth in claim 1, wherein each of the unit discharge sections has a rectangular shape, and the discharge gap extends diagonally in each of the rectangular unit discharge sections.

3. An electrode structure as set forth in claim 1, wherein the branch electrodes in each adjacent pair of the unit discharge sections are connected to each other.

4. An electrode structure as set forth in claim 1, wherein each of the branch electrodes has a portion extending along a non-discharge region to be connected to the corresponding bus electrode.

5. An electrode structure as set forth in claim 1, wherein each of the branch electrodes is curved.

6. An electrode structure as set forth in claim 1, wherein each of the bus electrodes is shared by an adjacent pair of the unit discharge sections arranged in the column of the matrix array.

7. An electrode structure as set forth in claim 1, wherein a barrier rib is provided, separating each adjacent pair of the unit discharge sections arranged in the row of the matrix array.

8. An electrode structure as set forth in claim 1, further comprising a signal electrode extending along the column of the matrix array in each of the unit discharge sections for selecting a cell to be actuated.

9. An electrode structure as set forth in claim 8, further comprising separate branch signal electrodes extending from the signal electrode in opposite directions along the branch electrodes, the branch signal electrodes substantially overlapping the branch electrodes, in a plan view.

10. An electrode structure as set forth in claim 9, wherein the separate branch signal electrodes are provided as an integrated branch signal electrode so as to substantially overlap the discharge gap, as well, in a plan view.

11. An electrode structure as set forth in claim 8, further comprising branch signal electrodes extending from the signal electrode along the bus electrodes in an opposite relation thereto, the branch signal electrodes substantially overlapping the bus electrodes in a plan view.

12. An electrode structure as set forth in claim 1, further comprising a dielectric layer formed on the substrate with the bus electrodes interposed therebetween, wherein portions of the dielectric layer on the bus electrodes are thicker than portions thereof on other areas of the substrate.

13. An electrode structure as set forth in claim 1, wherein barrier ribs are provided so as to substantially overlap the bus electrodes in a plan view.

14. An electrode structure for a plasma display panel having a plurality of unit discharge sections arranged in a discharge space defined between a pair of substrates, the electrode structure comprising:

a pair of bus electrodes; and a pair of branch electrodes respectively extending from the pair of bus electrodes in each of the unit discharge sections, wherein each of the unit discharge sections has a generally rectangular shape with two sides extending along the bus electrodes in a first direction and the other two sides extending in a second direction, perpendicular to, and being longer than, the two sides extending in the first direction, and each of the branch electrodes has a generally constant width and extends obliquely across a discharge region in each of the unit discharge sections so that the discharge gap defined between the branch electrodes is skewed with respect to the first direction.

15. An electrode structure as set forth in claim 14, further comprising a dielectric layer formed on the substrate with the bus electrodes interposed therebetween, wherein portions of the dielectric layer on the bus electrodes are thicker than portions thereof on other areas of the substrate.

16. An electrode structure as set forth in claim 14, wherein barrier ribs are provided so as to substantially overlap the bus electrodes in a plan view.

17. An electrode structure for a plasma display panel having a plurality of unit discharge sections arranged in a discharge space defined between a pair of substrates, the electrode structure comprising:

a pair of bus electrodes extending in a first direction; and a pair of branch electrodes respectively extending from the bus electrodes in each of the unit discharge sections, wherein each of the unit discharge sections has a shape elongated in a second direction, perpendicular to the first direction, and each of the branch electrodes has a generally constant width and extends obliquely across a discharge region in each of the unit discharge sections so that the discharge gap, defined between the branch electrodes, is skewed with respect to the first direction.

18. An electrode structure as set forth in claim 17, further comprising a dielectric layer formed on the substrate with the bus electrodes interposed therebetween, wherein portions of the dielectric layer on the bus electrodes are thicker than portions thereof on other areas of the substrate.

19. An electrode structure as set forth in claim 17, wherein barrier ribs are provided so as to substantially overlap the bus electrodes in a plan view.

* * * * *